US012453880B1

(12) United States Patent
Carter

(10) Patent No.: US 12,453,880 B1
(45) Date of Patent: Oct. 28, 2025

(54) PHYSICAL TRAINING APPARATUS AND METHOD OF USE THEREOF

(71) Applicant: Paul E. Carter, Atmore, AL (US)

(72) Inventor: Paul E. Carter, Atmore, AL (US)

( * ) Notice: Subject to any disclaimer, the term of this patent is extended or adjusted under 35 U.S.C. 154(b) by 256 days.

(21) Appl. No.: 18/111,384

(22) Filed: Feb. 17, 2023

(51) Int. Cl.
*A63B 21/062* (2006.01)
*A63B 21/00* (2006.01)

(52) U.S. Cl.
CPC ..... *A63B 21/0628* (2015.10); *A63B 21/156* (2013.01); *A63B 21/4003* (2015.10); *A63B 21/4009* (2015.10); *A63B 21/4029* (2015.10); *A63B 21/4035* (2015.10); *A63B 21/00047* (2013.01); *A63B 2225/093* (2013.01); *A63B 2225/107* (2013.01)

(58) Field of Classification Search
CPC ..... A63B 21/0628; A63B 21/156; A63B 21/4003; A63B 21/4009; A63B 21/4029; A63B 21/4035; A63B 2225/093; A63B 2225/107; A63B 17/00; A63B 17/02; A63B 17/04; A63B 21/15; A63B 21/151; A63B 21/152; A63B 21/154; A63B 21/16; A63B 21/1681; A63B 21/4019; A63B 21/4023; A63B 21/4025; A63B 21/00047; A63B 21/062; A63B 21/0626; A63B 21/063; A63B 21/0632; A63B 21/4033; A63B 21/4039; A63B 22/0002; A63B 22/0015; A63B 22/20; A63B 22/201; A63B 22/203; A63B 22/205; A61H 1/0229; A61H 1/0218; A61H 1/0292; A61H 1/0296
See application file for complete search history.

(56) References Cited

U.S. PATENT DOCUMENTS

| | | | |
|---|---|---|---|
| 4,052,070 | A | 10/1977 | Lew |
| 4,551,108 | A | 11/1985 | Bass |
| 4,632,388 | A | 12/1986 | Schleffendorf |
| 4,775,146 | A | 10/1988 | Stankovic |
| 4,784,384 | A | 11/1988 | Deola |
| 4,809,972 | A | 3/1989 | Rasmussen |

(Continued)

FOREIGN PATENT DOCUMENTS

| | | | |
|---|---|---|---|
| CA | 2696781 A1 * | 2/2009 | ..... A63B 21/00047 |
| EP | 1031359 A1 | 2/1999 | |

(Continued)

OTHER PUBLICATIONS

GIKPAL Adjustable Weight Bench (https://www.amazon.com/Adjustable-Utility-Workout-Foldable-Incline/dp/B08FWVDSHB/ref=cm_cr_arp_d_product_top?ie=UTF8&th=1; archived Aug. 14, 2020, accessed Oct. 24, 2024; hereinafter: "GIKPAL Adjustable Weight Bench") (Year: 2020).*

*Primary Examiner* — Loan B Jimenez
(74) *Attorney, Agent, or Firm* — AdamsIP, LLC

(57) ABSTRACT

A physical training apparatus includes a base surrounded by a large frame having an interior into which a user may enter to perform various types of training exercises. Multiple weight modules are attached to the frame and spaced apart from each other around a perimeter of the base and frame. The weight modules provide resistance vectors that originate in all directions around the user and that can also be varied vertically relative to the user. The apparatus may also include various types of training equipment that can be used in combination with the weight modules, such as a body harness, a bench with a back support, and a headpiece.

20 Claims, 20 Drawing Sheets

(56) References Cited

U.S. PATENT DOCUMENTS 4,898,381 A 2/1990 Gordon
4,907,798 A 3/1990 Burchatz
4,968,028 A 11/1990 Wehrell
5,050,871 A 9/1991 Douglas
5,054,773 A 10/1991 Parviainen
5,184,992 A 2/1993 Banks
5,211,614 A 5/1993 Henes
5,261,865 A 11/1993 Trainor
5,328,428 A 7/1994 Huang
5,403,253 A 4/1995 Gaylord
5,433,688 A 7/1995 Davies
5,466,204 A 11/1995 Nearing
5,635,665 A 6/1997 Kishi et al.
5,807,219 A 9/1998 Webber et al.
5,941,807 A 8/1999 Cassidy
6,238,323 B1 5/2001 Simonson
6,299,568 B1 10/2001 Prok
6,447,430 B1 9/2002 Webb et al.
6,488,612 B2 12/2002 Sechrest et al.
6,554,747 B1 4/2003 Rempe
6,592,498 B1 7/2003 Trainor
6,612,845 B1 9/2003 Macri et al.
6,685,600 B1 2/2004 Ullman
6,921,355 B2 7/2005 Campanaro et al.
6,932,748 B2 8/2005 Huang
6,966,870 B2 11/2005 Lan
7,044,897 B2 5/2006 Myers et al.
7,063,649 B2 6/2006 Szultka et al.
7,172,538 B2 2/2007 Keiser
7,226,402 B1 6/2007 Joya
7,255,666 B2 8/2007 Cardenas
7,314,437 B2 1/2008 Frappier
7,335,141 B2 2/2008 Piane, Jr.
7,494,453 B2 2/2009 Wehrell
7,503,882 B2 3/2009 Sechrest et al.
7,591,763 B1 9/2009 Fucci
7,601,105 B1 10/2009 Gipson, III et al.
7,608,026 B1 10/2009 Nicassio
7,651,450 B2 1/2010 Wehrell
7,707,652 B2 5/2010 Senegal
7,736,286 B2 6/2010 Panaiotov
7,785,242 B2 8/2010 Solomon
7,798,946 B2 9/2010 Dalebout et al.
7,887,471 B2 2/2011 McSorley
7,922,632 B2 4/2011 Chou
7,927,262 B2 4/2011 Clark
7,967,736 B2 6/2011 D'Silva et al.
7,998,041 B1 8/2011 Johnson
8,057,368 B1 11/2011 Lyszczarz
8,096,926 B1 1/2012 Batca
8,308,620 B2 11/2012 Lyszczarz
8,333,681 B2 12/2012 Schmidt
8,403,818 B1 3/2013 Wilkinson et al.
8,608,629 B2 12/2013 Latronica
8,727,952 B1 5/2014 Carle
9,061,176 B2 * 6/2015 Nikkaran ..... A63B 21/154
9,265,987 B2 2/2016 Richard et al.
9,289,644 B2 3/2016 Carson
9,295,871 B2 3/2016 Luedeka
9,302,136 B2 4/2016 Lyszczarz
9,302,139 B2 4/2016 Habing et al.
9,387,355 B1 7/2016 Joya
9,555,283 B2 1/2017 Jolly
9,616,274 B2 4/2017 Wehrell
9,700,751 B2 7/2017 Verdi
9,789,350 B1 * 10/2017 Wu ..... A63B 21/0442
9,802,072 B2 10/2017 Wehrell
9,821,188 B2 11/2017 Dwork et al.
D808,475 S 1/2018 Meredith et al.
10,016,646 B2 7/2018 Butler
10,046,194 B2 8/2018 Celebrini et al.
10,071,275 B2 9/2018 Beaver
10,265,565 B2 4/2019 Jue et al.
10,286,279 B2 5/2019 Wehrell
10,350,445 B2 7/2019 Hockridge
10,751,565 B2 8/2020 Saadallah
10,765,911 B1 9/2020 Hamoy
10,843,035 B2 11/2020 Jolly
10,857,409 B2 12/2020 Schreiber et al.
10,967,224 B2 4/2021 Beaver et al.
2002/0091043 A1 * 7/2002 Rexach ..... A63B 21/0628 482/99
2003/0017918 A1 1/2003 Webb et al.
2003/0166440 A1 * 9/2003 Cole ..... A63B 21/4029 482/121
2004/0043873 A1 3/2004 Wilkinson et al.
2006/0116249 A1 6/2006 Dibble et al.
2006/0135329 A1 6/2006 Owen
2006/0240956 A1 * 10/2006 Piane ..... A63B 21/0628 482/99
2006/0264305 A1 11/2006 Klassen
2007/0015642 A1 1/2007 Demeniuk
2007/0032357 A1 2/2007 Piane, Jr.
2007/0049471 A1 3/2007 Huang
2007/0232461 A1 10/2007 Jenkins et al.
2009/0143202 A1 * 6/2009 Carter ..... A63B 23/03566 482/99
2011/0021329 A1 1/2011 Dunne
2012/0322628 A1 12/2012 Gautier
2013/0345031 A1 * 12/2013 Chiu ..... A63B 23/03541 482/130
2014/0194260 A1 7/2014 Campanaro et al.
2014/0342882 A1 11/2014 Huang et al.
2019/0118022 A1 4/2019 Carter
2020/0114196 A1 4/2020 Habing et al.
2022/0111244 A1 4/2022 Hunt et al.
2022/0266086 A1 * 8/2022 Harvot ..... A63B 21/4029

FOREIGN PATENT DOCUMENTS

WO 2007014423 A1 2/2007
WO 2010008271 A1 1/2010
WO 2013102686 A1 7/2013
WO WO-2017116764 A1 * 7/2017 ..... A63B 21/0058
ZA 200902324 A * 1/2010 ..... A63B 21/06

* cited by examiner

PHYSICAL TRAINING APPARATUS AND METHOD OF USE THEREOF

FIELD OF THE INVENTION

The present disclosure relates generally to a physical training apparatus that provides resistance training utilizing resistance vectors from varying points of origin relative to a user.

BACKGROUND

Physical training and conditioning are known to enhance physical abilities and motor skills and may also be used for physical therapy and pain management. A variety of physical training techniques, such as resistance training, are commonly utilized. Resistance training may be performed for different purposes, such as for cardio training, for building muscle mass through weight training, or for physical rehabilitation, the purpose of which is generally to maintain or restore a user to being able to perform various common tasks with minimal or no pain. Sometimes weight training or other types of physical training may itself be the cause of pain due to injuries sustained during training. In many other cases, body pain may be caused by accidents or may slowly increase through age. However, many types of resistance training are not particularly effective at reducing a user's physical pain, particularly pain concentrated in the back and neck areas.

Accordingly, there exists a need in the art for a physical training apparatus that may be used generally for resistance training and that is effective for reducing or eliminating physical pain.

SUMMARY

In one aspect, a physical training apparatus and a method of using the physical training apparatus are provided. The apparatus comprises a base designed to support a user and a rigid frame that surrounds the base. The apparatus includes a plurality of weight modules each attached to the frame and disposed at spaced intervals around a perimeter of the base so that the user may position themselves on the base within the perimeter of the frame and train utilizing resistance vectors that generally extend in a 360-degree arc around the user. Each weight module comprises a stack of weights and a cable connected to the weights for resistance training. A stanchion is attached to the frame, and a pulley is connected to the stanchion. The height of the pulley can be adjusted so that a resistance angle is adjustable by adjusting the height of the pulley. Thus, resistance vectors can be varied in all directions both horizontally and vertically relative to the user.

In a preferred embodiment, the apparatus also provides resistance vectors from directions that are generally both above and below the user when the user is standing at the center of the base. A pair of overhead pulleys may be attached to the frame and positioned overhead relative to the user. A cable may extend through each of the overhead pulleys and to two of the weight modules so that the user may perform resistance training using either of the user's arms or both arms simultaneously from a generally overhead position. Similarly, a pair of lower pulleys may be secured to the base and positioned generally at the feet of the user on opposite sides of the user when the user is standing at the center of the base. A cable may extend through each of the lower pulleys and to two of the weight modules so that the user may perform resistance training using either of the user's arms or both arms simultaneously from a generally lower position so that the resistance vectors extend from the floor on opposing sides of the user. The overhead pulleys allow the user to train utilizing resistance vectors from a position higher than what would be achievable by raising a pulley connected to a stanchion to the highest possible position. Similarly, the lower pulleys allow the user to train utilizing resistance vectors from a position lower than what would be achievable by lowering a pulley connected to a stanchion to the lowest possible position.

In a preferred embodiment, the apparatus further comprises additional training equipment that may be utilized in combination with the weight modules and varying resistance vectors. The additional training equipment preferably includes a harness adapted to be worn around the waist of the user, a bench having an adjustable back support, and a headpiece adapted to be worn on the user's head. The harness comprises a plurality of connectors disposed at spaced intervals around the harness so that the connectors are spaced apart around the user's waist when the harness is worn. Each of the connectors is configured to be removably secured to one of the cables of one of the weight modules. Multiple connectors may be connected to cables of weight modules on opposing sides of the user to form resistance vectors from the user's waist in opposing directions. Using the harness with opposing resistance vectors around the user's waist may help to enhance the user's balance, flexibility, and strength.

The bench may be placed on the base within the perimeter of the frame so that the bench may be utilized in conjunction with the weight modules. The bench may rest on the base or may be removably secured to the base so that the bench can be removed at times when the user desires to use the weight modules for training without the bench. The bench comprises a back support having an adjustable height relative to the top of the bench. The back support preferably comprises a pair of padded rollers positioned longitudinally adjacent to each other and disposed horizontally above an upper surface of the bench. The adjacent rollers are designed so that a roller contacts each side of the user's back when leaning onto the back support. In a preferred embodiment, the back support comprises a plurality of pairs of padded rollers arranged in rows with the rows being positioned laterally adjacent to one another and arranged with each other to collectively form a curved back support that generally defines an upwardly facing convex curve. Thus, when the bench with the back support is placed on the base within the frame, the user may sit on the bench while using the weight modules for resistance training. When doing so, the user may move their upper body in a manner in which the back support presses against the user's lower back to support the user's back when the user moves their upper body in a backward direction against the back support. This motion during resistance training may help to stretch and strengthen the user's back and lower extremities while also reducing back pain.

The headpiece, which may be utilized with or without the bench or the harness, comprises a plurality of connectors disposed at spaced intervals around the headpiece so that the connectors are spaced apart around the user's head when the headpiece is worn. Each connector is configured to be removably secured to a cable of one of the plurality of weight modules. Multiple connectors may be connected to cables of weight modules on opposing sides of the user to form resistance vectors from the user's head in opposing directions. Thus, when wearing the headpiece, the user may exercise their neck by moving their head in opposite directions against the resistance of the weights attached to the opposing end of the cable through the pulley connected to the stanchion. Using the headpiece with opposing resistance vectors around the user's head may help to stretch and strengthen the user's neck while also reducing neck, shoulder, and upper back pain.

The present physical training apparatus provides maximum flexibility in the ways in which the apparatus may be utilized for resistance training, and is particularly advantageous in facilitating resistance training that aids in relieving back and neck pain. Because the apparatus may be used by a user in either a sitting or standing position with resistance vectors from the user's waist, arms, head, or combinations thereof, that are adjustable both vertically and horizontally around a 360-degree arc, the apparatus provides a wide range of possible resistance vectors for simultaneous resistance training for muscle groups throughout most of the human body.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

In one aspect, a physical training apparatus 10 and a method of using the physical training apparatus 10 for resistance training are provided. The apparatus 10 is designed to provide maximum flexibility in the types of exercises that may be performed using the apparatus in part by providing resistance vectors that may be varied to originate from numerous different angles relative to a user 12. The angles of the resistance vectors may be varied both vertically relative to the user 12 and horizontally around a 360-degree arc relative to the user 12. The apparatus 10 may also include other pieces of training equipment that may optionally be utilized with the variable angles of the resistance vectors to enhance physical training and aid in reducing pain for the user 12. FIGS. 1-20 illustrate various preferred implementations of the apparatus 10 or components thereof.

Figure 1:
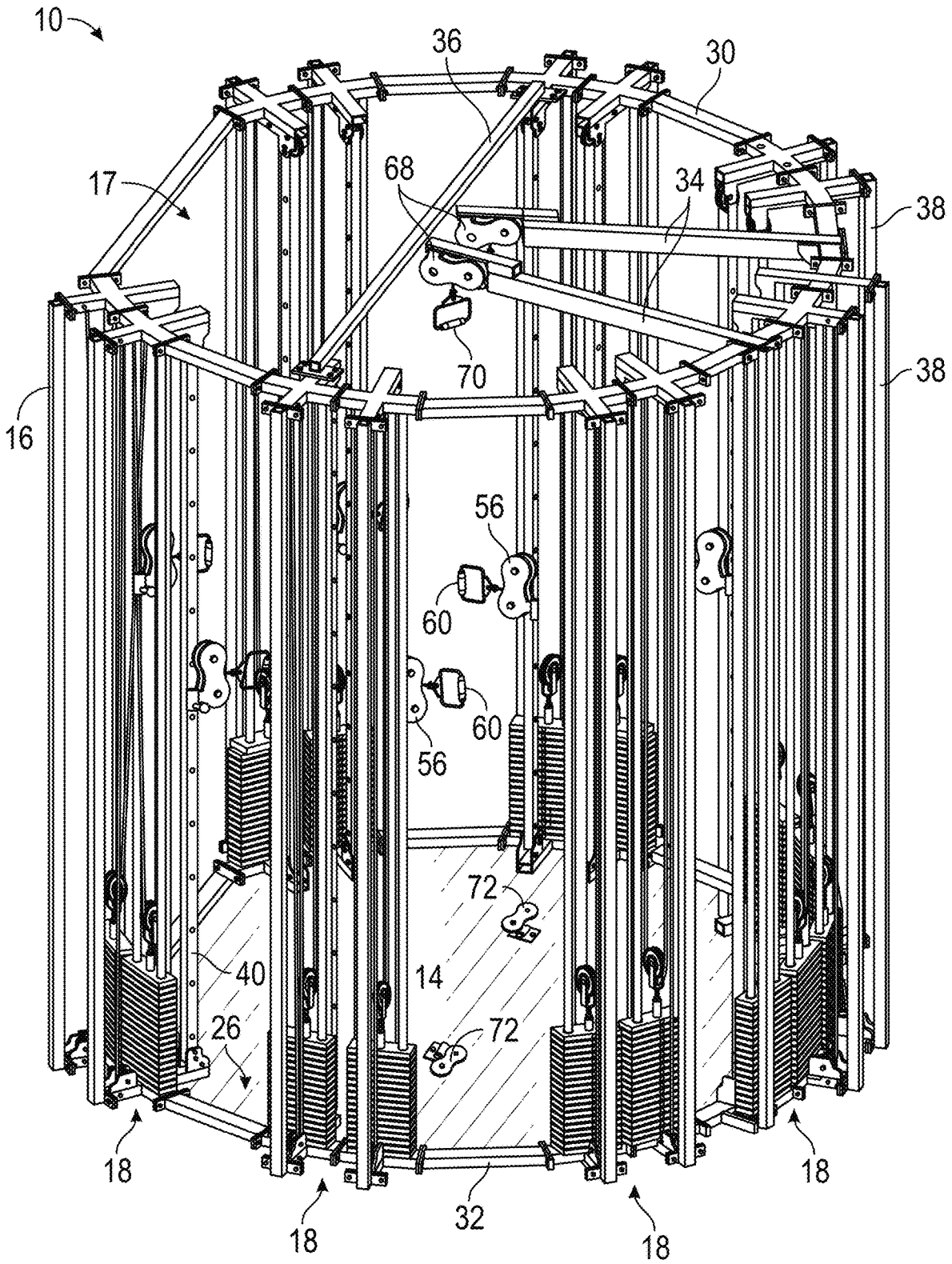
FIG. 1 shows a perspective view of a physical training apparatus in accordance with the present disclosure.

FIG. 1 shows an embodiment of the apparatus 10 that provides resistance vectors that may be varied relative to a user 12. The apparatus 10 comprises a base 14 having an upper surface 26 that is designed to support a user 12 and a rigid frame 16 that surrounds the base 14. The frame 16 preferably comprises an upper frame member 30 and a lower frame member 32 each having approximately the same shape and overall footprint, which is preferably a generally circular or polygonal shape that defines a perimeter of the base 14. The upper frame member 30 and the lower frame member 32 may be attached to each other by a plurality of vertical support columns 38 to form a rigid frame structure 16 that defines an interior of the apparatus 10 into which the user 12 may enter to utilize the apparatus 10 for resistance training. The frame 16 preferably also includes a crossbar 36 that is attached to the upper frame member 30 at opposing ends of the crossbar 36. The crossbar 36 extends across the apparatus 10 and above the base 14 to provide additional structural support for the frame 16. The base 14 may be a floor that the frame 16 rests upon, in which case the frame 16 may optionally be bolted or otherwise fastened to the floor to secure the frame 16 in place, or the base 14 may be a separate structure from the floor, in which case the base 14 may be attached to the lower frame member 32. Preferably, the upper surface 26 of the base 14 is a generally flat and horizontal surface. The base 14 may optionally be padded or have a pad placed on top of the upper surface 26 of the base 14.

Figure 2:
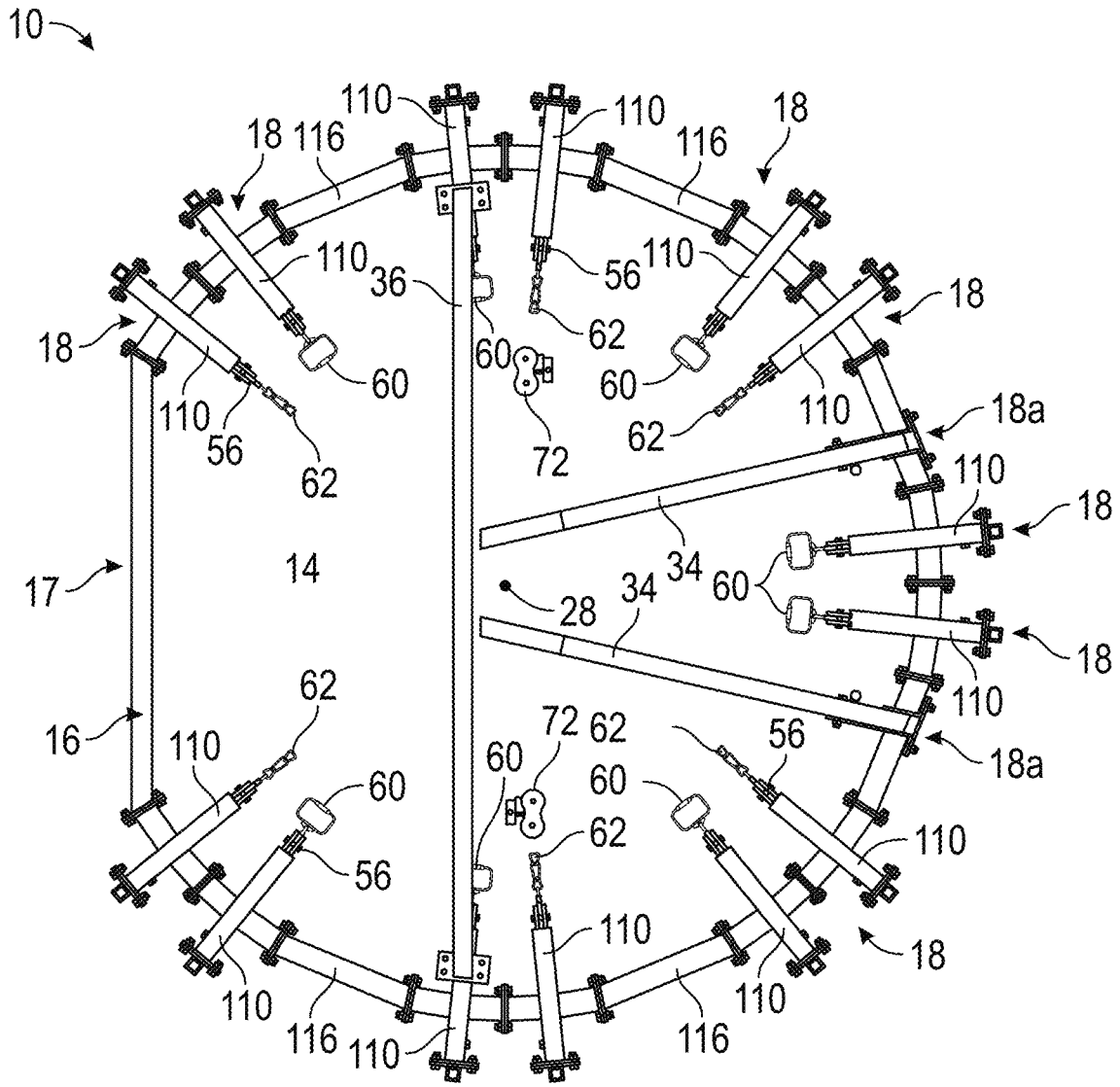
FIG. 2 shows a schematic view of a physical training apparatus in accordance with the present disclosure.
Figure 7:
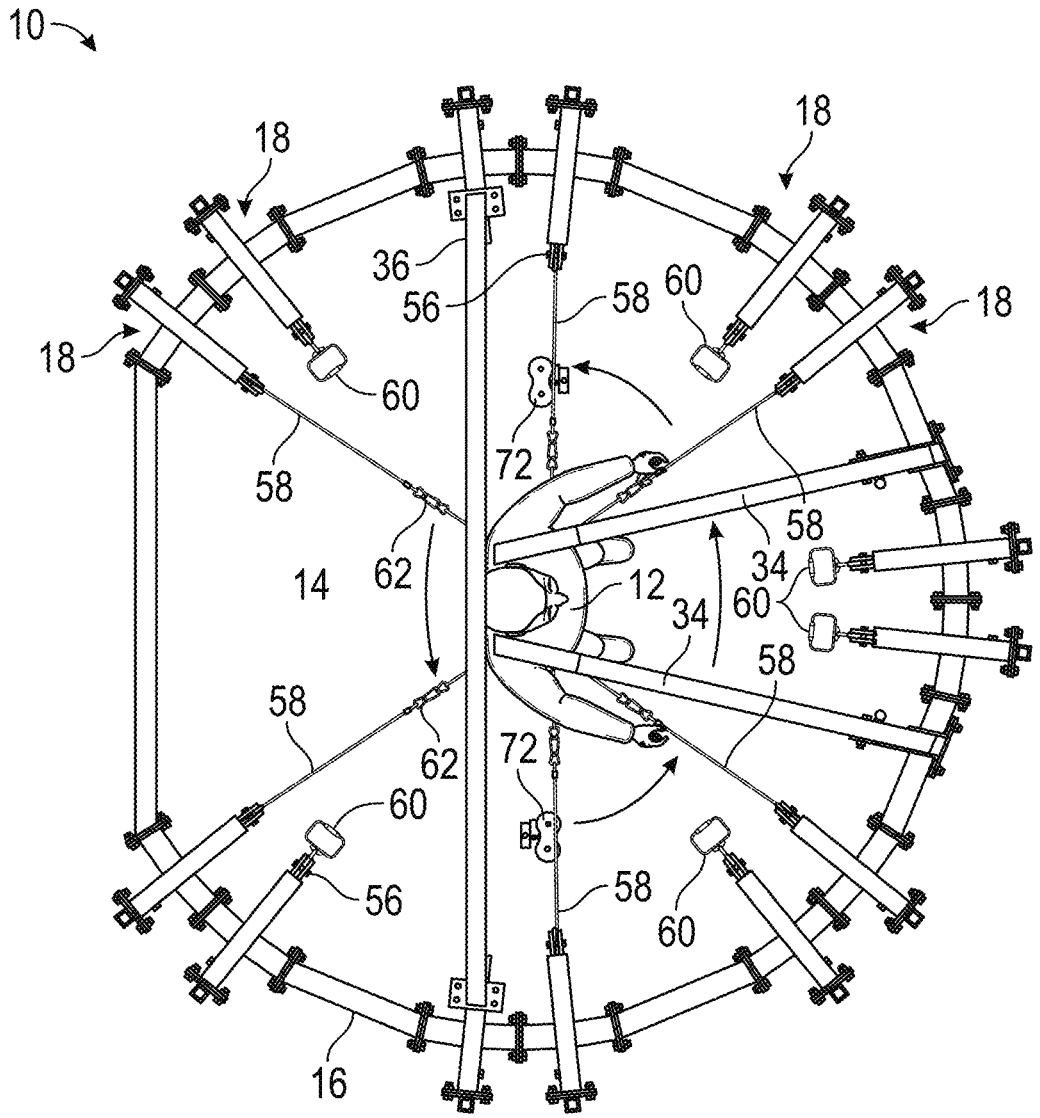
FIG. 7 shows a top view of a user using a physical training apparatus in accordance with the present disclosure.
Figure 8:
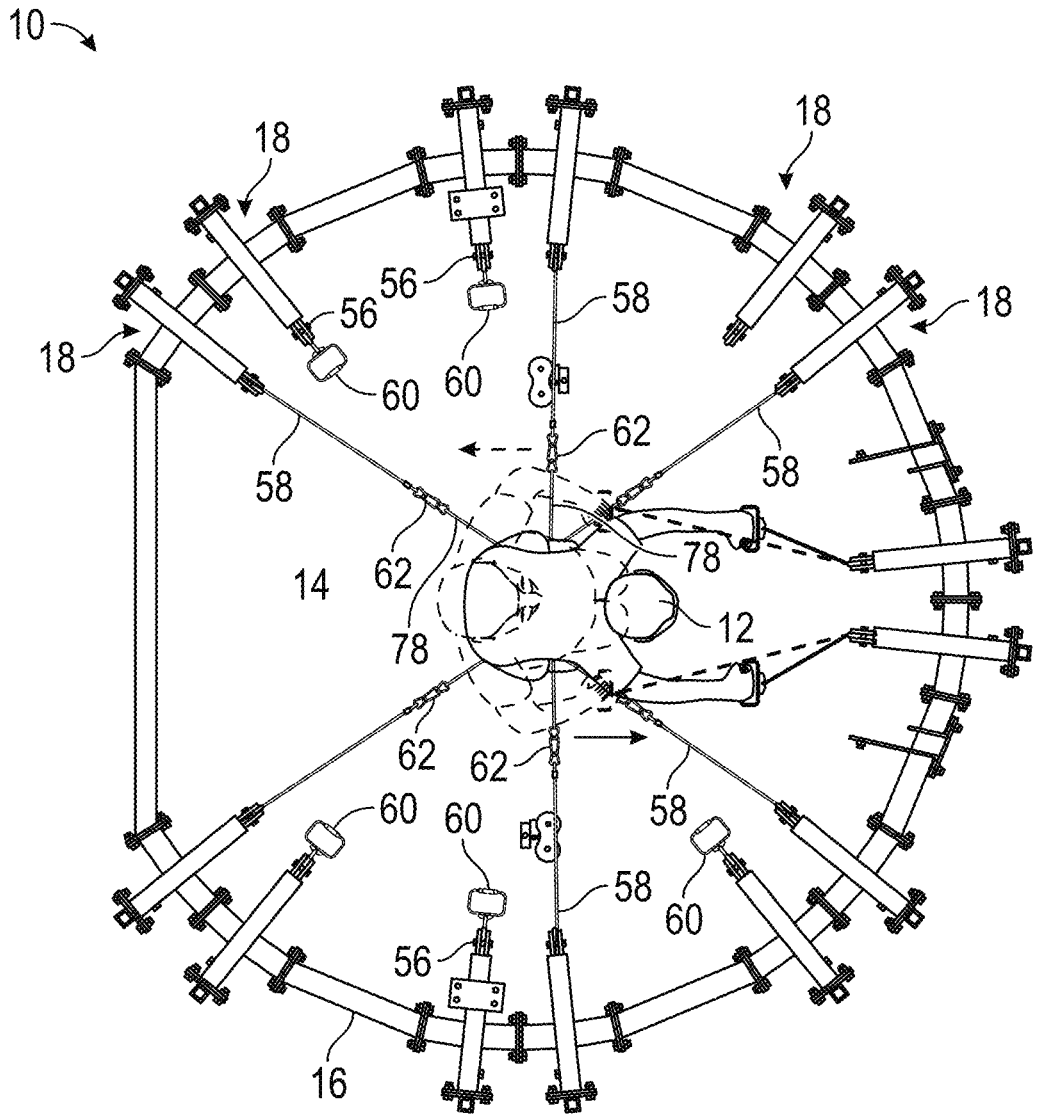
FIG. 8 shows a top view of a user using a physical training apparatus in accordance with the present disclosure.

The apparatus 10 includes a plurality of weight modules 18 each attached to the frame 16 and disposed at spaced intervals around a perimeter of the base 14 so that the user 12 may position themselves on the base 14 within the perimeter of the frame 16 and train utilizing resistance vectors that generally extend in a 360-degree arc around the user 12, as best seen in FIGS. 7 and 8. In a preferred embodiment, as best seen in FIG. 2, the weight modules 18 are disposed at spaced intervals around a perimeter of the base 14 so that each of the weight modules 18 is generally equidistant from a center point 28 of the upper surface 26 of the base 14. As described in detail below, the present apparatus 10 may be utilized for a variety of resistance training exercises, some of which may be performed in a standing position and some of which may be performed while seated on a bench 22. When using the apparatus 10 in a standing position, the user 12 may stand over an area of the base 14 that is generally around the center point 28 for most exercises so that each of the weight modules 18 is generally about the same distance from the location where the user 12 is standing within the frame 16.

Figure 3:
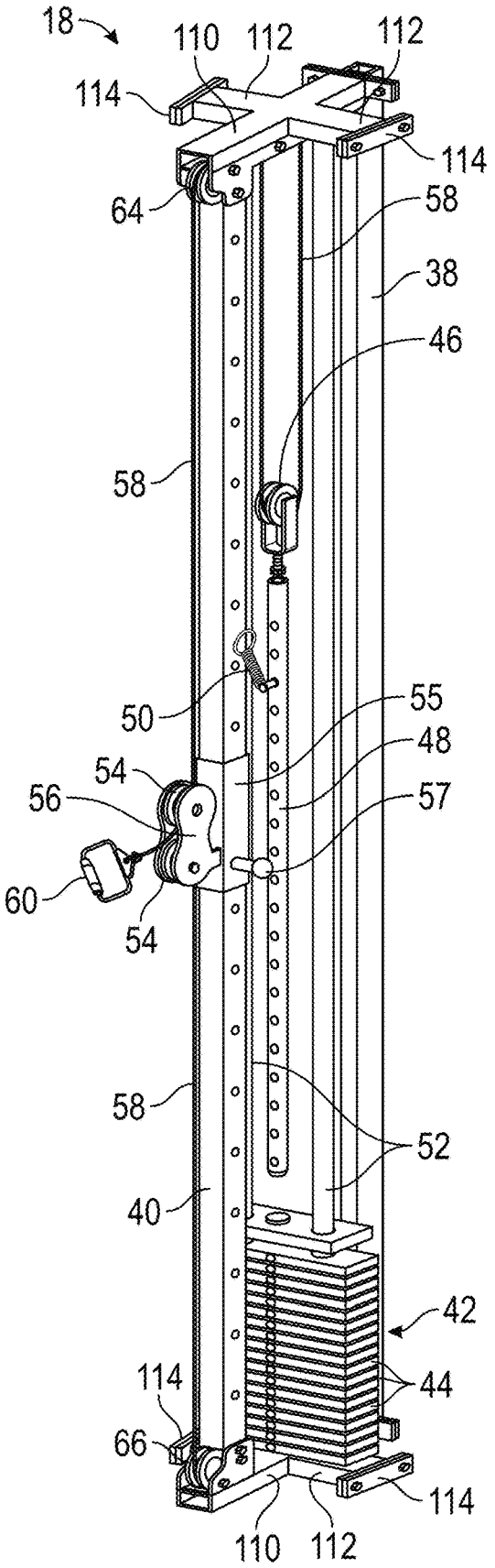
FIG. 3 shows a perspective weight module of a physical training apparatus in accordance with the present disclosure.

FIG. 3 illustrates one of the weight modules 18 detached from the apparatus 10. Each weight module 18 preferably includes at least one vertical support column 38 that provides structural support for the frame 16 by rigidly connecting the upper frame member 30 to the lower frame member 32. The weight modules 18, including the vertical support columns 38, in combination with interconnecting structural members 116, form the upper frame member 30 and the lower frame member 32, which together define a cage-like structure that surrounds the base 14. The weight modules 18 may be spaced apart sufficiently so that the user 12 may enter into the interior of the frame 16 between weight modules 18; however, in a preferred embodiment, one portion of the frame 16 has a larger space between adjacent weight modules 18 to define an entryway 17 through which the user 12 may enter the apparatus 10 and through which equipment such as a bench 22 may be moved onto the base 14 and into the interior of the frame 16.

Each weight module 18 comprises a stack 42 of individual weights 44 and a cable 58 operably connected to the stack of weights 42 via a weight pulley 46 connected to the stack 42 to allow resistance training by pulling the cable 58 to lift the stack of weights 42. The weight pulley 46 is preferably attached to an upper end of a rod 48 configured to adjust the number of weights 44 that may be lifted by the user 12. The rod 48 may be inserted into aligned openings in each weight 44 in the stack 42, and a pin 50 may be inserted through a separate opening in one of the weights 44 in the stack 42 and into a hole in the rod 48 to adjust the number of weights 44 that are lifted. Each weight module 18 preferably also includes a pair of vertical guide rods 52 that also extend through aligned openings in each weight 44 in the stack 42 on either side of the adjuster rod 48 to keep all of the weights 44 in vertical alignment as the weights 44 move up and down along the guide rods 52 as the user 12 lifts and lowers the weights 44 during normal use.

In a preferred embodiment, as shown in FIG. 3, each weight module 18, or at least a portion of the individual weight modules, includes a stanchion 40 that is attached to the frame 16. The stanchion 40 is a vertical support member that is preferably attached to both the upper frame member 30 and to the lower frame member 32 at opposing ends of the stanchion 40. To connect the stanchion 40 to the frame 16, each weight module 18 preferably comprises an upper and lower stanchion support member 110, as best seen in FIG. 3. Each stanchion support member 110 may be attached to two opposing lateral support members 112 each having flanged ends 114 for connecting a weight module 18 to an adjacent weight module 18 or to an interconnecting member 116 that connects two adjacent weight modules 18, as best seen in FIG. 2. The upper frame member 30 and lower frame member 32 may each be formed by a combination of stanchion support members 110, lateral support members 112, and interconnecting members 116. A stanchion pulley 54 is connected to the stanchion 40 for guiding the cable 58 to the weight pulley 46 for lifting the stack of weights 42. As best seen in FIG. 3, the height of the stanchion pulley 54 can be adjusted along the height of the stanchion 40. By changing the height of the stanchion pulley 54, a resistance angle between the user 12 and the weight module 18 may be adjusted as desired, which allows resistance vectors to be varied vertically along the height of the stanchion 40 relative to the user 12.

In a preferred embodiment, each weight module 18 comprises a stanchion pulley assembly 56 that includes two pulleys 54 that are mounted adjacent to each other in an aligned position. As best seen in FIG. 3, the pulley assembly 56 may be attached to a bracket 55 that is configured to secure the pulley assembly 56 to the stanchion 40. The bracket 55 may be moved up or down on the stanchion 40 and secured to the stanchion 40 at a desired height using a pin 57 or other suitable type of fastening mechanism. By utilizing two pulleys 54, either pulley 54 may be utilized depending on specific configurations of the module 18. In addition, the two pulleys 54 may prevent a handle 60 attached to the cable 58 from sliding through the pulleys 54 and disengaging from the pulley assembly 56.

As best seen in FIG. 2, an end of each of the cables 58 of each weight module 18 may have a handle 60 for the user 12 to pull in order to perform resistance training directly using the user's arms to lift the weight stack 42, or the cable 58 may have a cable connector 62 that allows the cable 58 to be connected to a separate piece of training equipment, such as a harness 20 or a headpiece 24.

In a preferred embodiment, each weight module 18 further comprises one or more additional pulleys positioned for guiding the cable 58 from an end engaged by the user 12 to the weight stack 42. In a preferred embodiment, each weight module 18 comprises one or more upper guide pulleys 64 and one or more lower guide pulleys 66 for guiding the cable 58 when using the apparatus 10 in different configurations. When utilizing the stanchion pulley 54 to set the angle of the resistance vector, the cable 58 may run from an end with a handle 60 or connector 62, through the stanchion pulley 54, then through the upper guide pulleys 64 (only one of which is visible in FIG. 3), and then through the weight pulley 46 that is connected to the weight stack 42. The cable 58 may then run through another upper guide pulley (not shown) and back down to a lower guide pulley (not shown) on a rear side of the weight stack 42. The cable 58 may then run under the weight stack 42 to another lower guide pulley 66 and back up to the stanchion pulley assembly 56 to form a loop. An opposing end of the cable 58 may be removably attached to the bracket 55 to which the stanchion pulley assembly 56 is attached. Thus, the bracket 55 can be moved vertically along the stanchion 40 to adjust the height of the stanchion pulley 54 utilizing a cable 58 of a fixed length. The opposing end of the cable 58 may also be detached from bracket 55 in some configurations for performing different exercises. For instance, as in the configuration shown in FIG. 12, the opposing end of a cable 58 may be detached from bracket 55 and then run through a floor pulley 72 and attached to a handle 74, as discussed below.

Figure 3A:
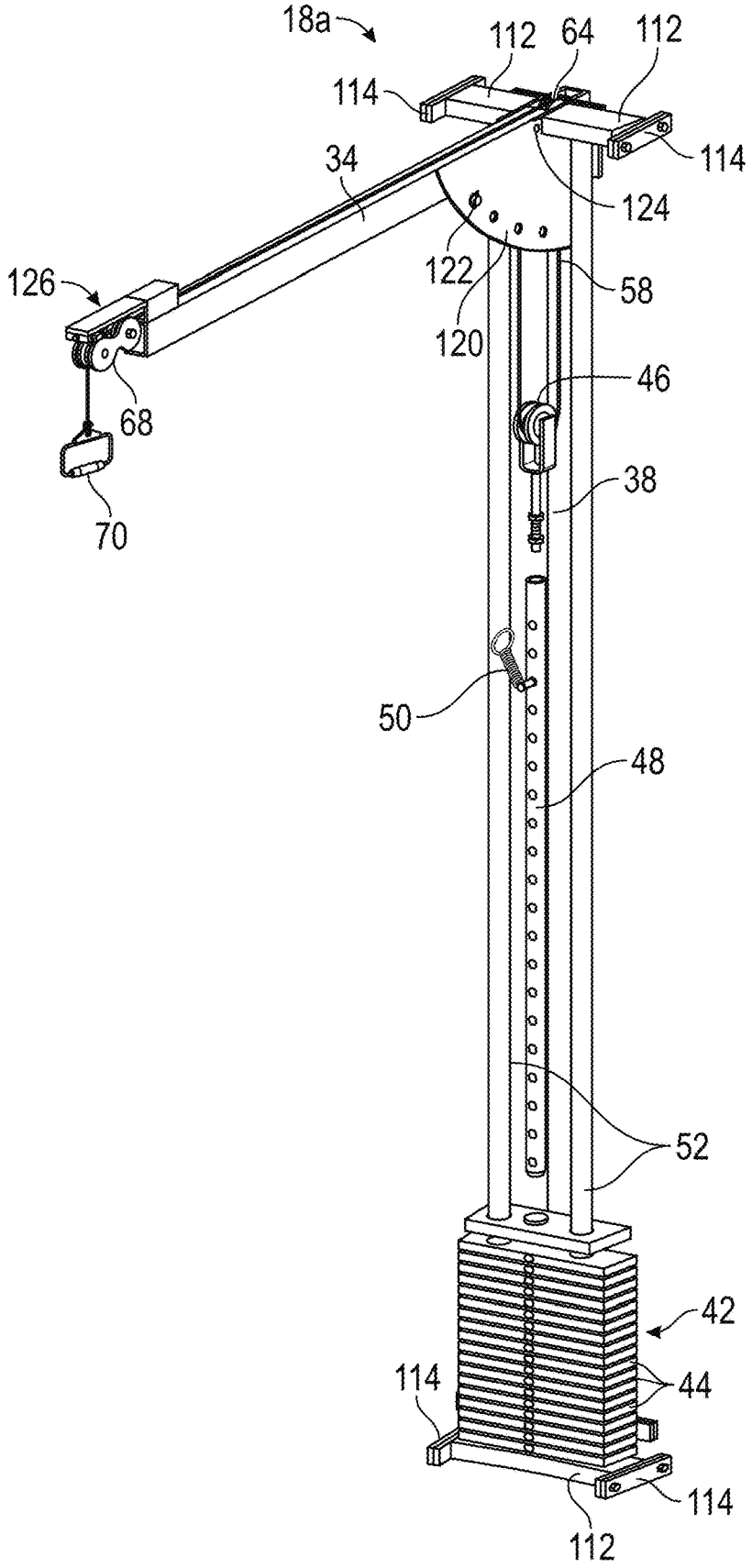
FIG. 3A shows a perspective weight module of a physical training apparatus in accordance with the present disclosure.
Figure 11:
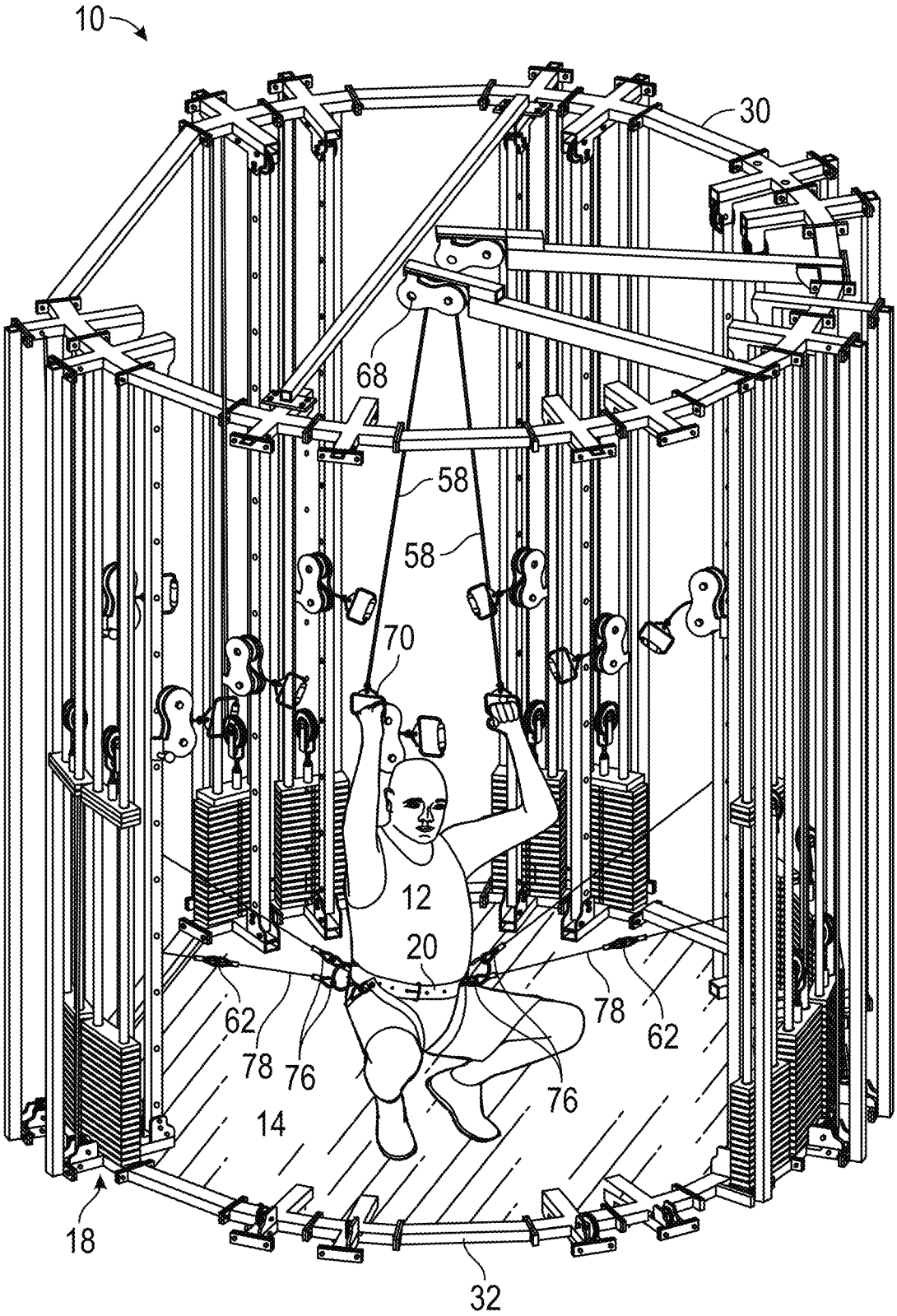
FIG. 11 shows a perspective view of a user using a physical training apparatus in accordance with the present disclosure.
Figure 12:
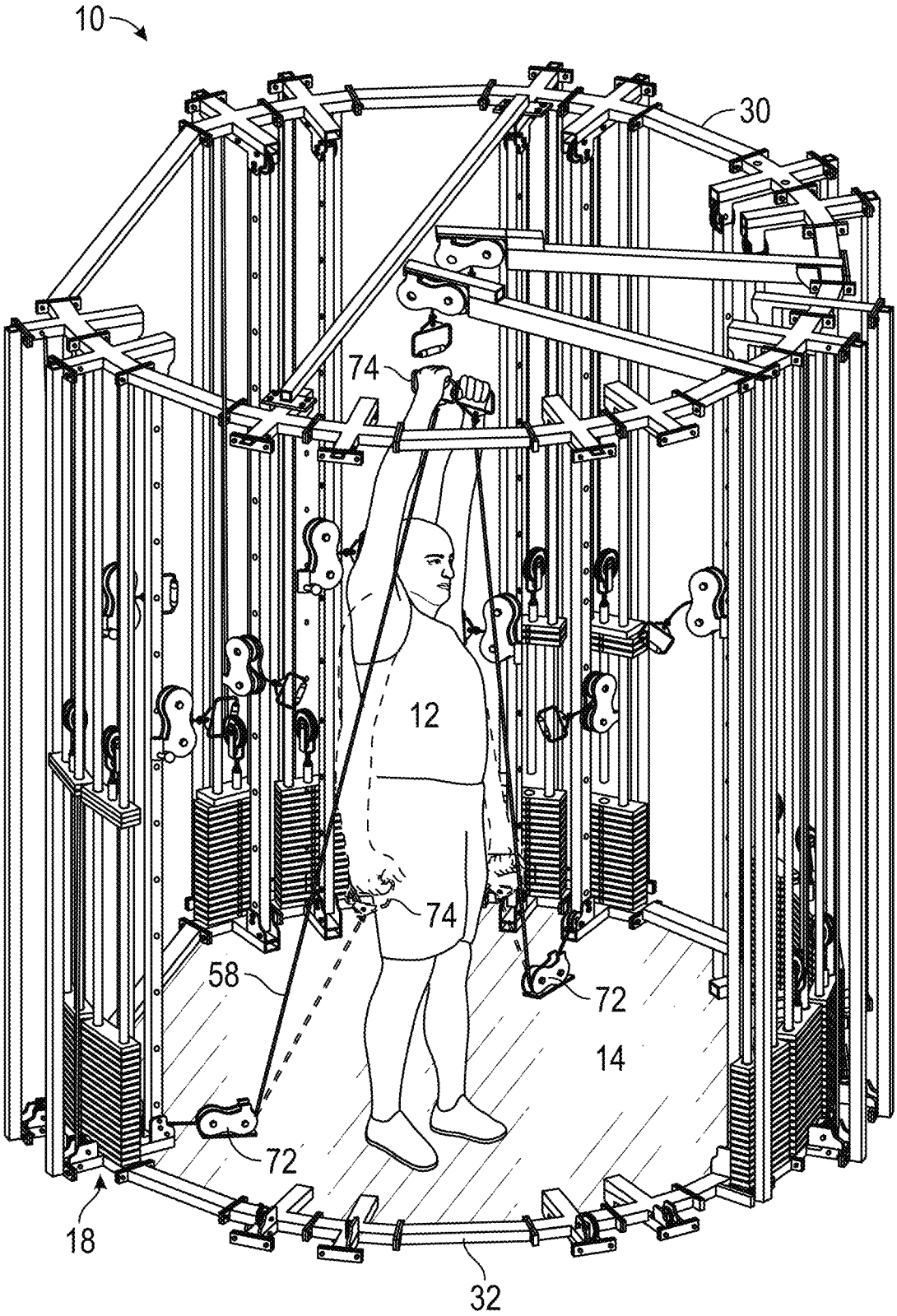
FIG. 12 shows a perspective view of a user using a physical training apparatus in accordance with the present disclosure.

In a preferred embodiment, as best seen in FIGS. 11 and 12, the apparatus 10 also provides resistance vectors from directions that are generally both above and below the user 12 when the user is standing at the center of the base 14. FIG. 3A illustrates a weight module 18*a* that may be utilized for providing overhead resistance vectors originating above the user 12. The apparatus 10 preferably includes two of these modules 18*a*, as best shown in FIG. 2, to provide an overhead resistance vector for each of the user's arms. The weight module 18*a* shown in FIG. 3A may be specifically designed for this purpose and preferably includes a boom arm 34 having a proximal end 124 attached to a lateral support member 112 that forms a portion of the upper frame member 30 of the frame 16. A pair of overhead pulleys 68 may each be attached to a distal end 126 of a respective one of the boom arms 34 and positioned overhead relative to the user 12. Alternatively, a single boom arm 34 may be utilized to support both overhead pulleys 68. Each boom arm 34 extends inwardly from the upper frame member 30 and over the upper surface 26 of the base 14. A cable 58 from one of the weight modules 18*a* may run through each of the two overhead pulleys 68 and may be connected to an overhead handle 70 that is positioned above the user 12 when the user 12 is standing on the base 14 within the frame 16. As shown in FIG. 3A, the modules 18*a* used with the overhead pulleys 68 may optionally not include a stanchion 40 and thus may not include stanchion pulleys 54. The cables 58 that run through the overhead pulleys 68 may run from the handle 70 through an upper guide pulley 64 and then down to a weight pulley 46 connected to a weight stack 42. The cable 58 may then run up from the weight pulley 46, and an opposing end of the cable 58 may be attached to the arm 34. The overhead pulleys 68 allow the user 12 to perform resistance training using either of the user's arms or both arms simultaneously from a generally overhead position. As best seen in FIG. 1, the overhead pulleys 68 may be installed as a component of a pulley assembly similar to the stanchion pulley assembly 56 so that each 68 includes two individual pulleys.

In a preferred embodiment, the positioning of each boom arm 34 is adjustable so that a height of the distal end 126 of each boom arm 34 is adjustable. This allows the height of the overhead pulleys 68 and handles 70 to be adjusted for individual users 12 of different heights. In a preferred embodiment, each module 18*a* used to support a boom arm 34 includes a vertically oriented adjustment plate 120, which may be attached to the vertical support column 38 and to a lateral support member 112, having a plurality of openings extending through the plate 120 in an arcing configuration. In this embodiment, the proximal end 124 of each boom arm 34 is pivotally attached to the upper frame member 30 so that the boom arm 34 can be rotated about a pivot point 124 at the proximal end of the arm 34, which may comprise a pin extending through the arm 34 so that the arm 34 can rotate about the pin. As shown in FIG. 3A, a pin 122 may then be inserted into one of the openings in the plate 120 and left in place to support the boom arm 34 in a desired position corresponding to a desired height of the distal end 126 of the arm 34 above the base 14 of the apparatus 10. To adjust the height of the boom arm 34, the pin 122 may be removed and the boom arm 34 may be pivoted to a different position. The pin 122 may then be reinserted into a different opening in the plate 120 to support the boom arm 34 at the desired height.

Similarly, a pair of floor pulleys 72 may be secured to the base 14 and positioned generally at the feet of the user 12 on opposite sides of the user when the user 12 is standing at the center of the base 14. A cable 58 from one of the weight modules 18 may run through each of the floor pulleys 72 and may be connected to a lower handle 74, which may be positioned on the floor adjacent to the user 12 when the user 12 is standing near the center of the base 14 within the frame 16. The cables 58 that run through the floor pulleys 72 may run from handle 74 through the lower guide pulleys 66, then through one or more upper guide pulleys 64, and to a weight stack 42. An end of the cable 58 opposite handle 60 may be detached from bracket 55 and attached to handle 74, which allows a single module 18 to be utilized with either a stanchion pulley 54 or a floor pulley 72 to allow for flexibility in exercise configurations. The floor pulleys 72 allow the user 12 to perform resistance training using either of the user's arms or both arms simultaneously from a generally lower position so that the resistance vectors extend from the base 14 on opposing sides of the user 12. The overhead pulleys 68 generally allow the user 12 to train utilizing resistance vectors from a position higher than what would be achievable by raising a stanchion pulley 54 to the highest possible position on the stanchion 40. Similarly, the floor pulleys 72 generally allow the user 12 to train utilizing resistance vectors from a position lower than what would be achievable by lowering a stanchion pulley 54 to the lowest possible position on the stanchion 40.

FIG. 2 illustrates a top view of a preferred configuration of the frame 16 and weight modules 18, 18*a*. In a preferred embodiment, the apparatus 10 has at least eighteen different origin points for resistance vectors, including two resistance vectors through the overhead pulleys 68, two resistance vectors through the floor pulleys 72, and fourteen resistance vectors originating from stanchion pulleys 54 that are attached to weight modules 18 disposed around the perimeter of the base 14, the resistance angle for each of these being adjustable along the height of the stanchion 40. In a preferred embodiment, the apparatus 10 comprises sixteen weight modules 18, 18*a*. In this embodiment, as illustrated in FIG. 2, fourteen of the weight modules 18 may be utilized for resistance vectors originating from stanchion pulleys 54 or from the pair of floor pulleys 72, and two of the weight modules 18*a* are utilized for resistance vectors originating from the pair of overhead pulleys 68. Each of the resistance vectors originating from the overhead pulleys 68 preferably has a dedicated weight module 18*a*, which is preferably located directly below a proximal end 124 of each of the boom arms 34 that support the overhead pulleys 68 where the boom arms 34 are attached to the upper frame member 30, as shown in FIG. 2. In this embodiment, the other fourteen weight modules 18 are preferably arranged in pairs that are spaced apart at equidistant intervals, as indicated by the stanchion support members 110 that each correspond to one of the weight modules 18 and are visible in the top view shown in FIG. 2, except in the location where the entryway 17 is located, which preferably lacks a weight module in order to provide greater access into the interior of the frame 16 of the apparatus 10. Thus, each pair of weight modules 18 is preferably spaced apart from an adjacent pair by an angle of approximately 45 degrees, except the pair of modules 18 on either side of entryway 17 are approximately 90 degrees apart from each other. In a preferred embodiment, the two weight modules 18*a* connected to the overhead pulleys 68 are disposed on opposite sides of a pair of modules 18 located directly opposite the entryway 17. Because these two modules 18*a* are preferably dedicated for use only with the overhead pulleys 68, these modules 18*a* may optionally not include a stanchion 40 or attached stanchion pulley assembly 56, and may instead have only one or more upper guide pulleys 64 attached to the module 18*a* in a fixed location on the module frame.

As best seen in FIG. 2, a distal end of each cable 58 of each weight module 18 preferably has either a handle 60 or a connector 62 attached thereto so that the user 12 can pull the handle 60 or connector 62 to pull the cable 58 through the stanchion pulley assembly 56. The user 12 may use the handles 60 for direct resistance training by pulling the handles 60 to lift the weight stacks 42. The cable connectors 62 may be used to connect the cables 58 to a piece of exercise equipment designed to aid in resistance training, such as a harness 20 or headpiece 24. In a preferred embodiment, as shown in FIG. 2, each of the pairs of adjacent weight modules 18 may include one module 18 with a handle 60 attached to the cable 58 and one module 18 with a connector 62 attached to the cable 58 to provide flexibility in the types of exercises that may be performed and to allow the user 12 to simultaneously use their arms and a separate piece of exercise equipment for resistance training. In a preferred embodiment, the pair of modules 18 located directly across from the entryway 17 both have handles 60 attached to the cables 58. In a preferred embodiment, the resistance vectors originating from the floor pulleys 72 do not have dedicated weight modules 18, but the lower handles 74 utilized for these vectors may be connected to cable connectors 62 after running the cables 58 through the floor pulleys 72 in order to provide a mechanism for utilizing these resistance vectors. Alternatively, the floor pulleys 72 may each have a dedicated weight module 18. The present configuration of weight modules 18, 18*a* and resistance vectors provides maximum flexibility in the types of resistance training exercises that may be performed by the user 12 and thus the different muscle groups that can be worked simultaneously. It should be understood by one of skill in the art that a different number of weight modules 18, 18*a* arranged in different configurations that provide resistance vectors that are adjustable both vertically and horizontally around a 360-degree arc relative to a user may be possible and still fall within the scope of the present disclosure.

Figure 4:
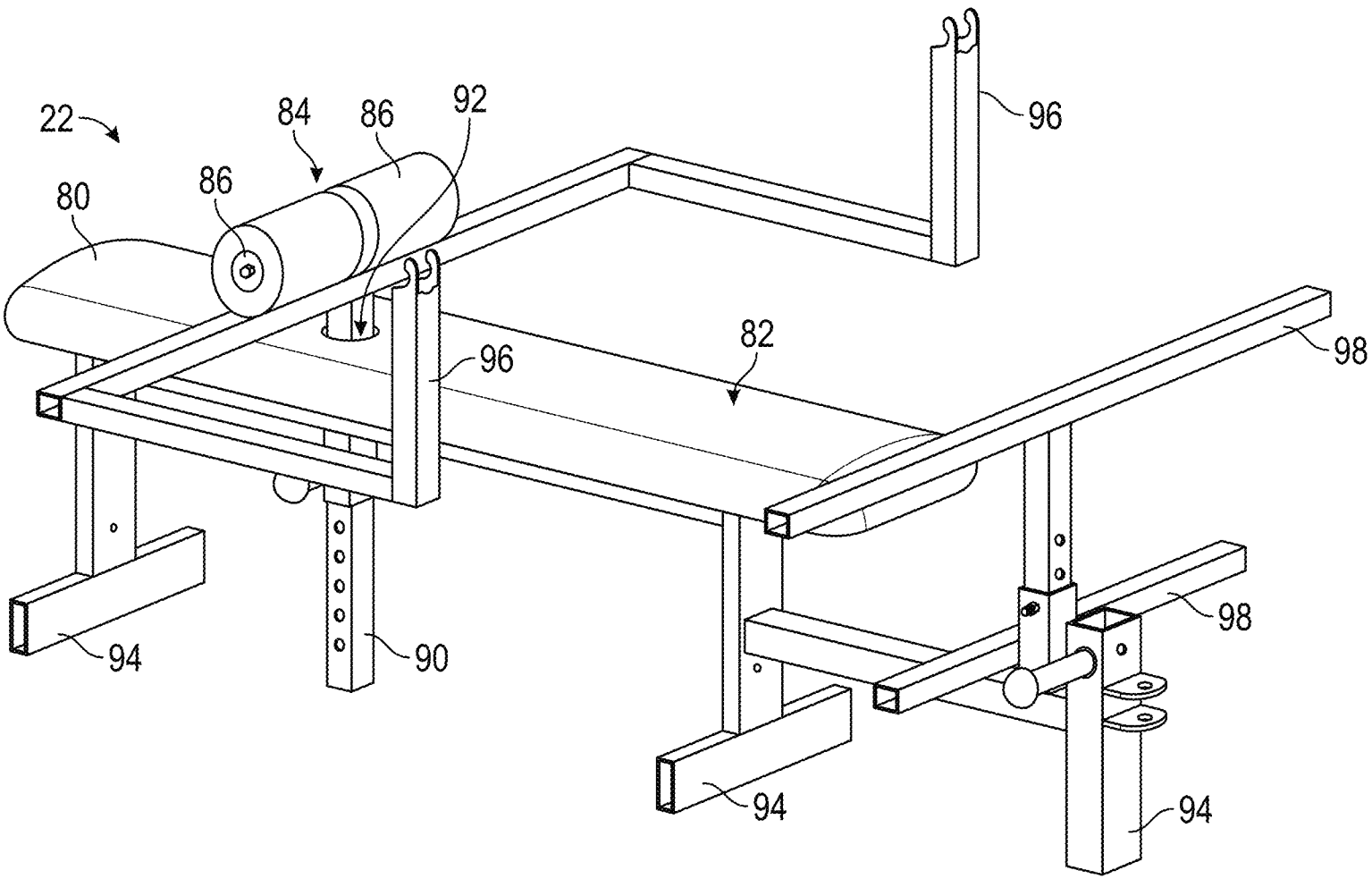
FIG. 4 shows a perspective view of a bench of a physical training apparatus in accordance with the present disclosure.
Figure 5:
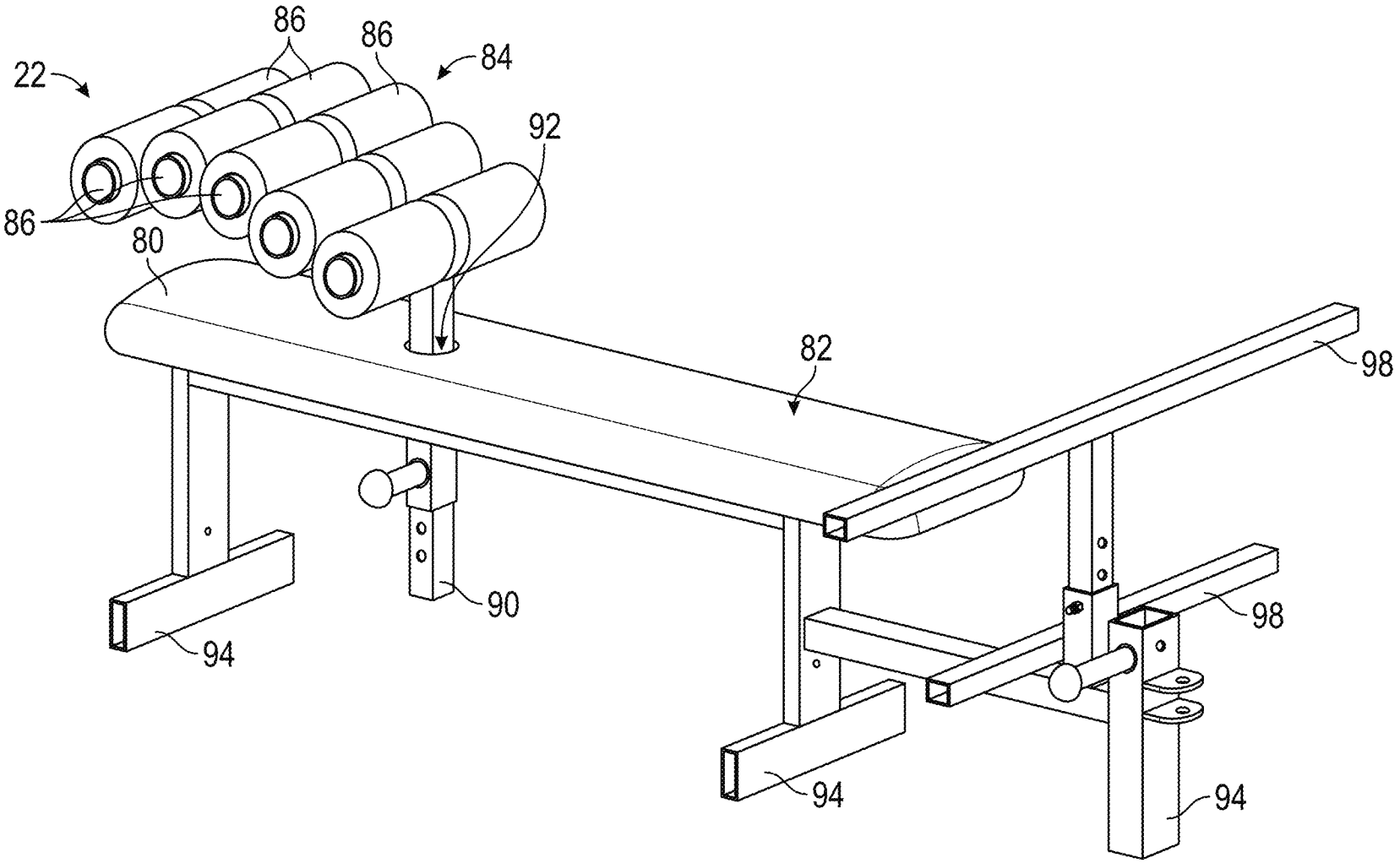
FIG. 5 shows a perspective view of a bench of a physical training apparatus in accordance with the present disclosure.
Figure 6:
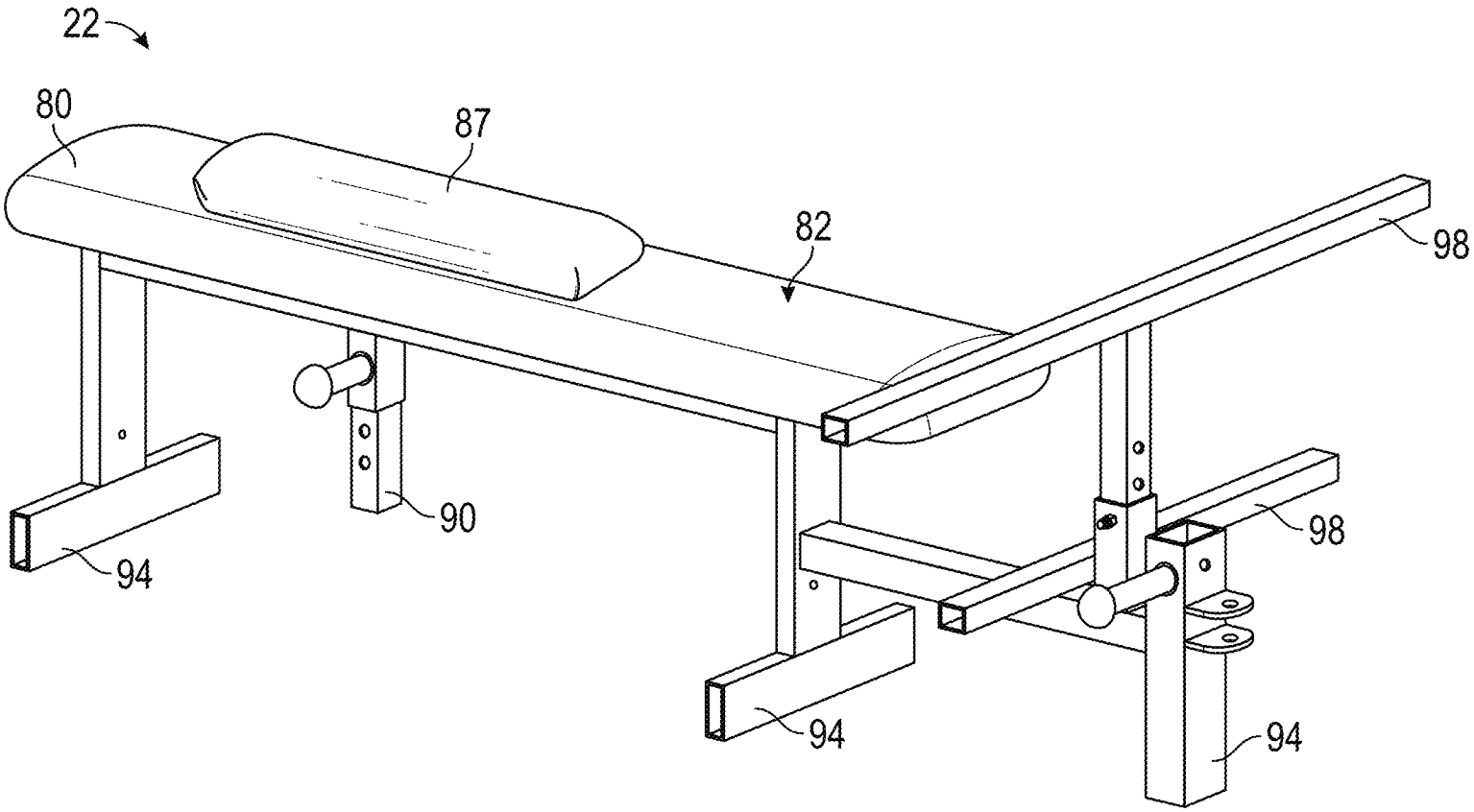
FIG. 6 shows a perspective view of a bench of a physical training apparatus in accordance with the present disclosure.
Figure 17:
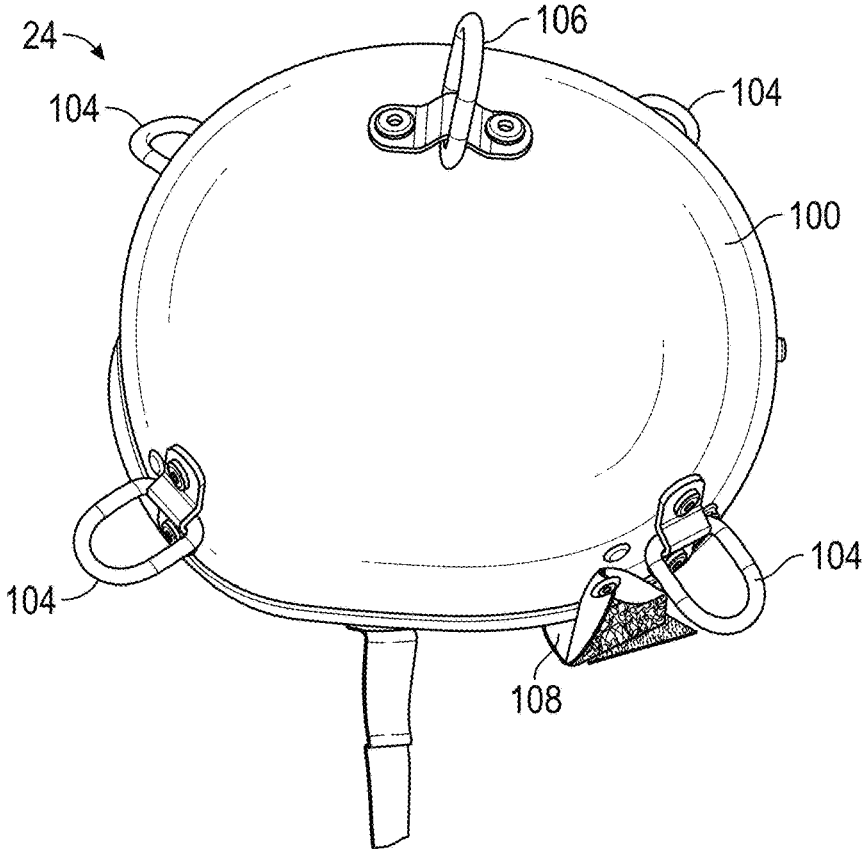
FIG. 17 shows a perspective view of a headpiece of a physical training apparatus in accordance with the present disclosure.
Figure 18:
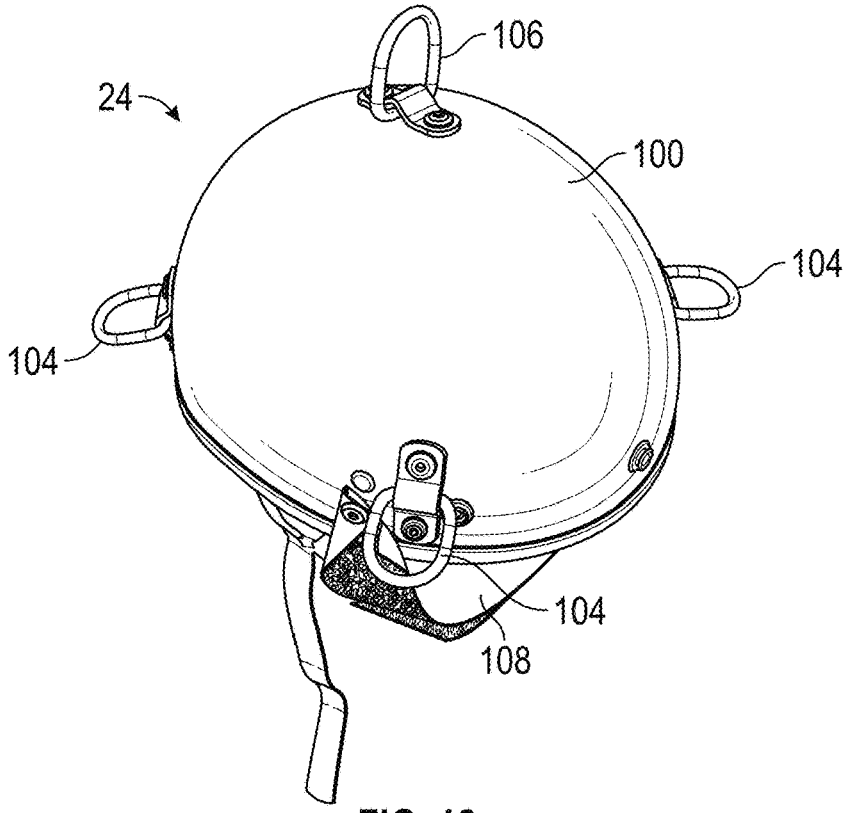
FIG. 18 shows a perspective view of a headpiece of a physical training apparatus in accordance with the present disclosure.
Figure 19:
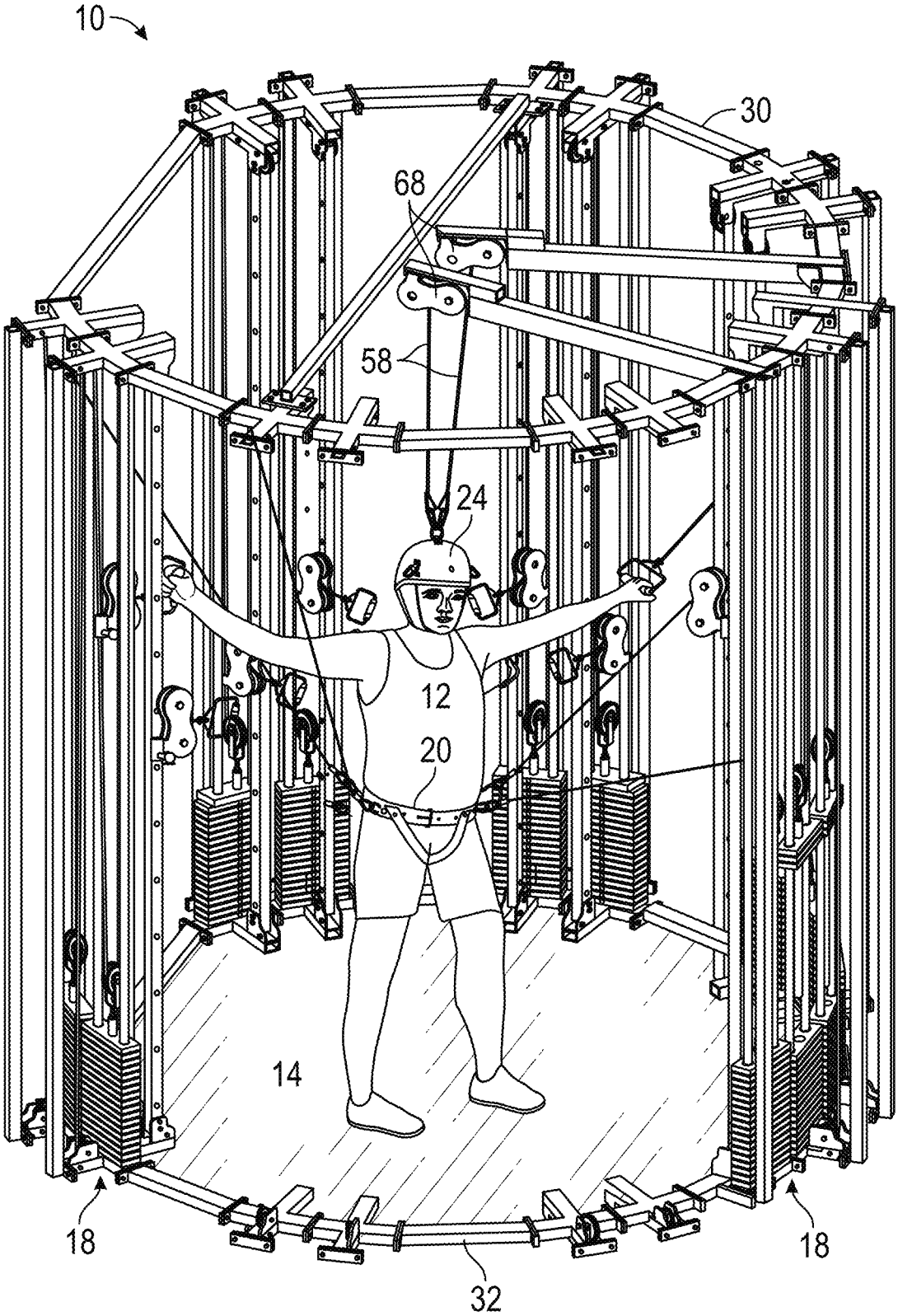
FIG. 19 shows a perspective view of a user using a physical training apparatus in accordance with the present disclosure.
Figure 20:
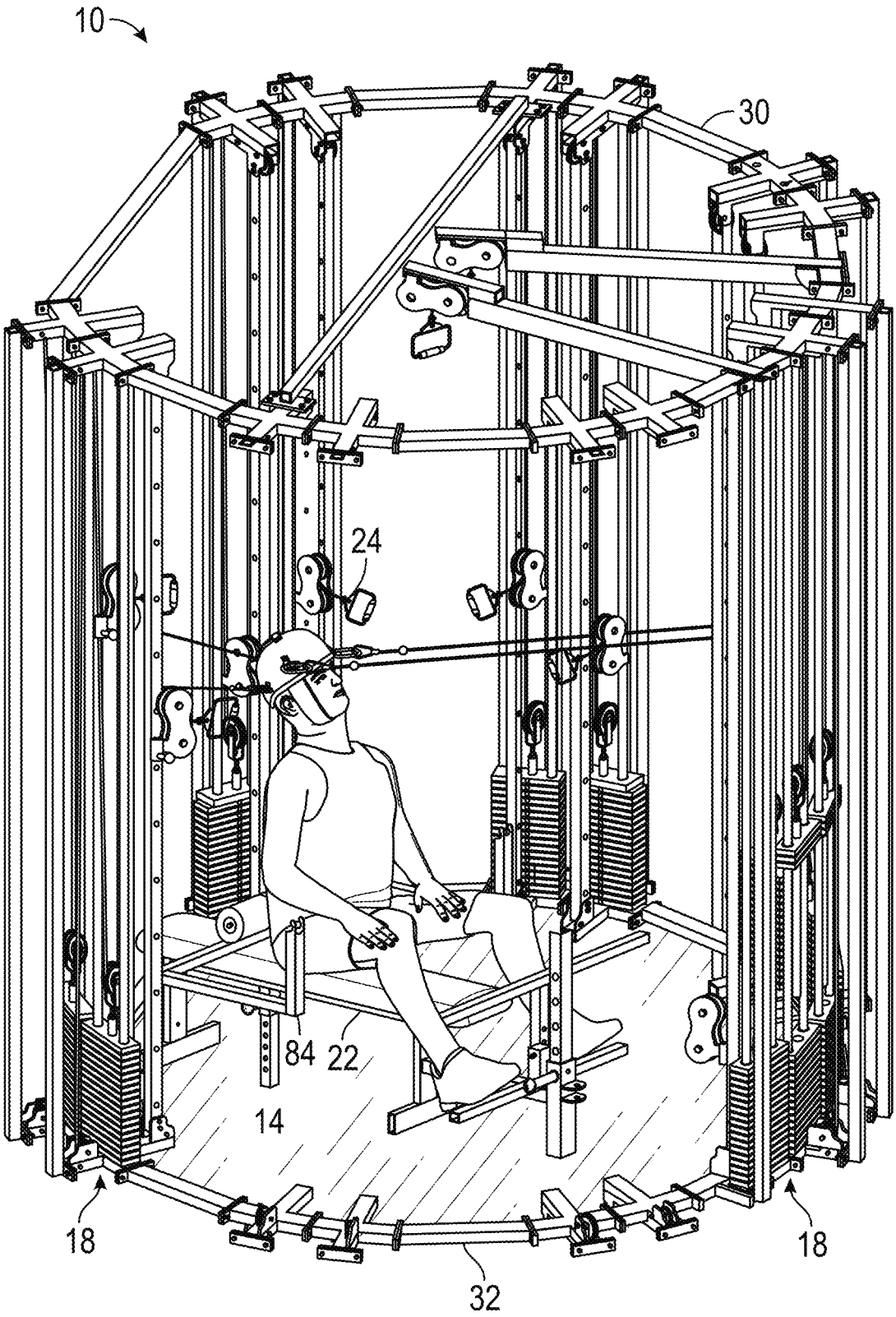
FIG. 20 shows a perspective view of a user using a physical training apparatus in accordance with the present disclosure.

In a preferred embodiment, the apparatus 10 further comprises additional training equipment that may be utilized in combination with the weight modules 18, 18*a* and variable resistance vectors. The additional training equipment preferably includes a harness 20 adapted to be worn around the waist of the user 12, a bench 22 having an adjustable back support 84, and a headpiece 24 adapted to be worn on the user's head. FIGS. 7-11 illustrate a user 12 performing exercises with the harness 20 and weight modules 18, 18*a*. FIGS. 4-6 illustrate various embodiments of the bench 22, and FIGS. 13-16 illustrate a user 12 performing exercises with the bench 22 and weight modules 18. FIGS. 17-18 illustrate a preferred embodiment of the headpiece 24, and FIGS. 19 and 20 illustrate a user 12 performing exercises with the headpiece 24 and weight modules 18, 18*a*.

Figure 9:
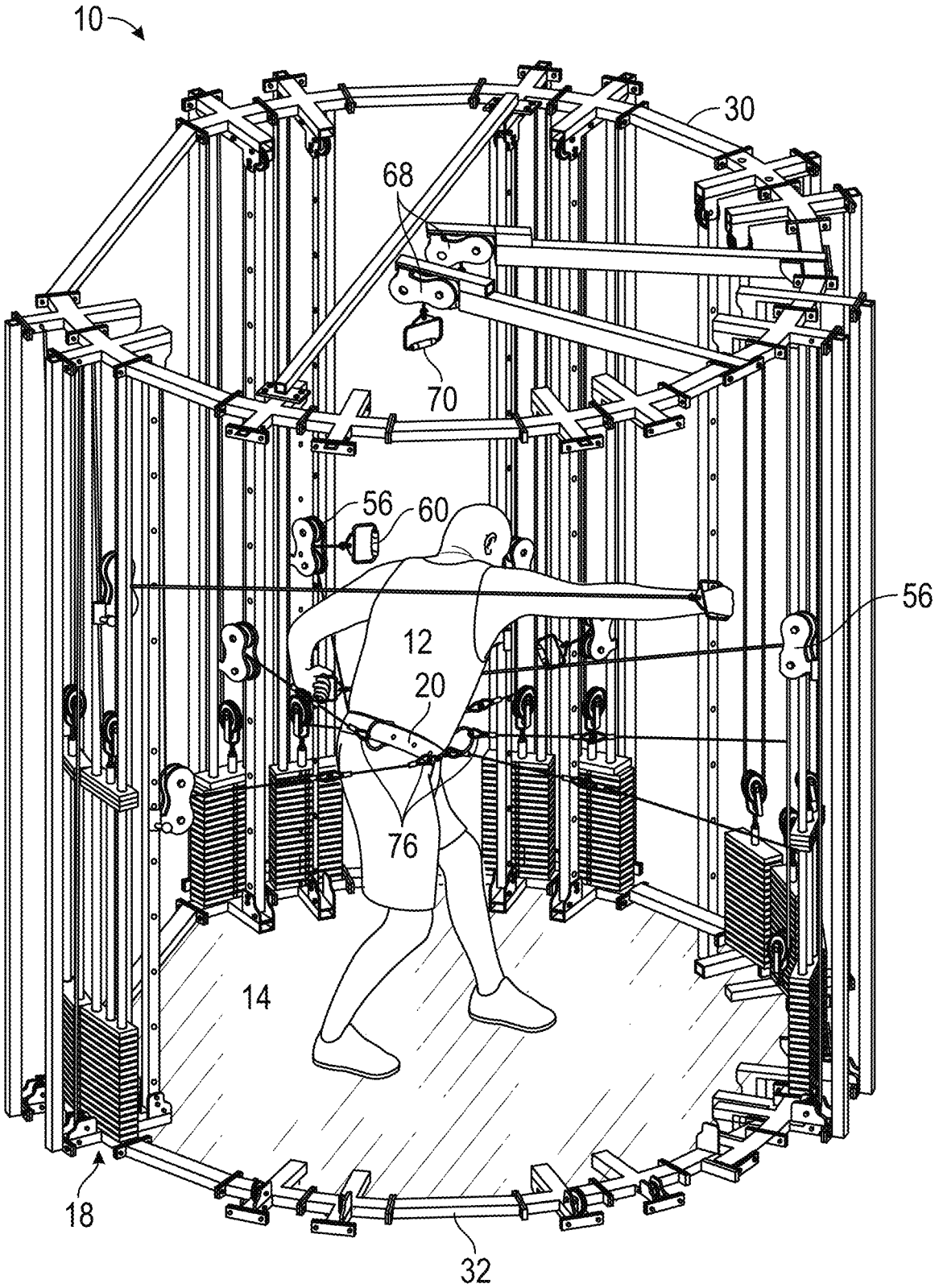
FIG. 9 shows a perspective view of a user using a physical training apparatus in accordance with the present disclosure.
Figure 10:
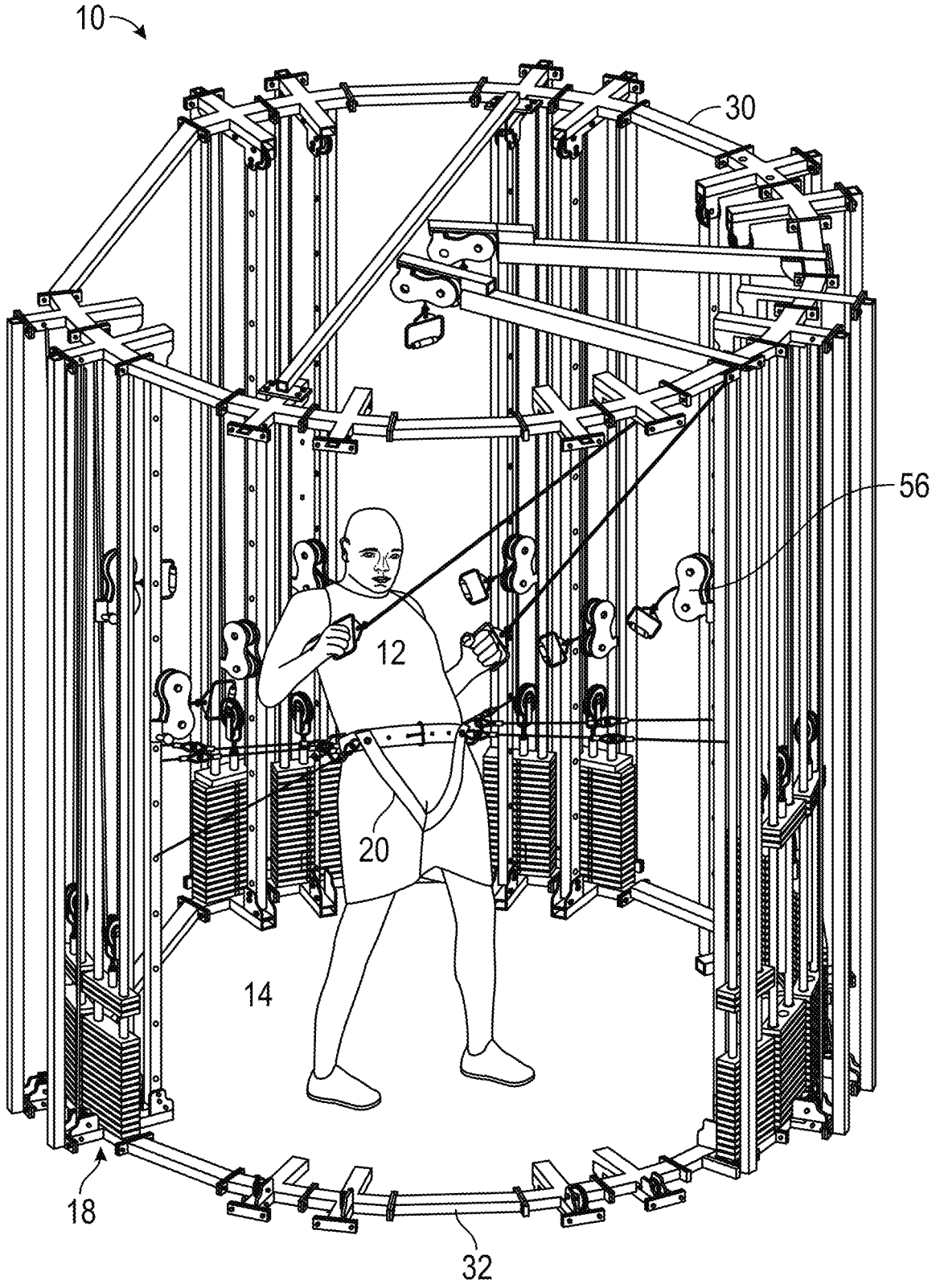
FIG. 10 shows a perspective view of a user using a physical training apparatus in accordance with the present disclosure.

As best seen in FIGS. 7-11, the harness 20 comprises a plurality of connectors 76 disposed at spaced intervals around the harness 20 so that the connectors 76 are spaced apart around the user's waist when the harness 20 is worn. The harness 20 preferably includes a belt portion that is securable around the user's waist and that has an adjustable length to accommodate different users having different waist sizes. The harness 20 preferably also includes portions that extend around upper portions of each of the user's legs, as best seen in FIG. 10, to ensure a tight fit to the user's body when performing resistance exercises that pull on the harness 20 during use. Each of the connectors 76 connected to the harness 20 is configured to be removably secured to one of the cables 58 of one of the weight modules 18. Multiple connectors 76 may be connected to multiple cables 58 of weight modules 18 on opposing sides of the user 12 to form resistance vectors extending from the user's waist area in opposing directions when the user 12 is positioned on the base 14 within the frame 16. In a preferred embodiment, as best seen in FIGS. 7 and 8, the harness 20 preferably comprises six connectors 76 spaced around the harness 20, including two connectors on the sides of the user's waist, two connectors on the user's front side, and two connectors on the user's back side, so that the harness 20 may be connected simultaneously to up to six different weight modules 18. The harness 20 may optionally include interconnecting cables 78 each configured to connect one of the harness connectors 76 to one of the cable connectors 62 so that each of the cables 58 may be sufficiently extended to connect to the harness 20, if necessary.

FIGS. 7-11 show examples of resistance training exercises that may be performed by the user 12 utilizing the harness 20 in combination with the weight modules 18, 18*a*. It should be understood by one of skill in the art that the illustrated exercises are examples and that numerous other exercises utilizing different resistance vectors from different parts of the user's body may be performed using the present apparatus 10. FIG. 7 shows the user 12 performing an exercise using only the harness 20 so that the resistance vectors all originate from the user's waist area and not from any other parts of the user's body. In this exercise, as indicated by the arrows, the user 12 is rotating their hips in a counterclockwise direction, which causes continuous resistance in a direction that is opposite the direction in which the user's hips are moving at any given time. To perform this particular exercise, the stanchion pulley assemblies 56 may preferably be positioned at a height on each of the stanchions 40 that is approximately the same height of the user's waist when the user is in a standing position. FIG. 8 shows the user 12 performing an exercise using the harness 20 in combination with arm exercises utilizing resistance vectors originating in front of the user 12. In this exercise, the user 12 is moving their hips backward in opposition to resistance vectors originating in front of the user while moving their shoulders forward, and then moving their hips forward in opposition to resistance vectors originating behind the user while moving their shoulders backward and simultaneously pulling the handles 60 with their hands to lift weight stacks 42 with each arm. When performing this exercise, the stanchion pulley assemblies 56 connected to the harness 20 may be positioned at waist height, and the stanchion pulley assemblies 56 being utilized for arm exercises may be positioned generally at a shoulder height.

FIGS. 9-11 show other variations of example exercises utilizing both the harness 20 and weight modules 18, 18*a*. In FIGS. 9-16 and 19-20, portions of the apparatus 10 including portions of the frame 16 and weight modules 18 are shown as being removed from the apparatus only for clarity of illustration in showing the user 12 performing exercises while being within the frame 16. Further, in some figures a cable connected to the harness may be shown as being removed if the weight module to which the cable would be connected is also removed from the figure. In FIG. 9, the user 12 is performing an exercise that is a variation of the exercise shown in FIG. 7 but that also incorporates arm exercises. In this exercise, the user 12 performs a back and forth twisting motion with both their hips and arms, thereby exercising both the user's arms and core simultaneously. When the user 12 twists in a counterclockwise direction, as shown in FIG. 9, the right arm extends outward to push a handle 60 toward the user's left side in opposition to a resistance vector originating from the user's right side, while the left arm is pulled back in opposition to a resistance vector originating from the user's left side. The user may then twist their body in the opposite direction to reverse the arm exercises and continue repeating the twisting motion.

In FIG. 10, the user 12 is performing an exercise that is a variation of the exercise shown in FIG. 8 but that changes the resistance angle of the resistance vector being utilized for the arm exercises. In this exercise, the stanchion pulley assemblies 56 on the weight modules 18 directly in front of the user 12 have been raised to an upper position on the stanchions 40. Thus, when the user moves their upper body backward, the shoulders and arms move in a more downward direction to pull the cables 58 to lift the weight stacks 42. This illustrates one example of many possible variations of exercises that may be facilitated by the present apparatus 10. In FIG. 11, the user 12 is performing an exercise that utilizes both the harness 20 and the overhead pulleys 68 in a squatting motion. In this exercise, the user's core is exercised by pulling downward simultaneously on all of the cables 58 connected to the harness 20, while also pulling downward on handles 70 to utilize resistance vectors originating overhead from pulleys 68. Training exercises utilizing the harness 20 as shown in these example exercises generally help the user 12 to increase core strength and reduce back pain.

FIG. 12 shows the user 12 performing resistance training utilizing resistance vectors originating from the floor pulleys 72. This exercise may be performed with or without the harness 20. In this exercise, the user 12 may raise both arms over their head and then lower both arms to their side to work on increasing arm strength. In another variation, the user may also perform a squatting motion while performing the arm exercises utilizing these resistance vectors.

In a preferred embodiment, the apparatus 10 further comprises a bench 22. FIGS. 4-6 show preferred embodiments of a bench 22 that may be utilized to perform various training exercises in combination with the weight modules 18, 18*a*. Preferably, the bench 22 can be moved through the entryway 17 to move the bench 22 onto the base 14 within the perimeter of the frame 16 for use with the weight modules 18, 18*a* so that the bench 22 can also be removed for use of the weight modules independently of the bench 22. Alternatively, the bench 22 may be permanently secured to the base 14. The bench 22 comprises an elevated platform 80 having an upper surface 82 designed to support a user 12. The bench 22 has a plurality of legs 94 that may rest on the base 14 and support the elevated platform 80 in an elevated position above the base 14. The platform 80 may optionally be padded for the comfort of the user 12. The bench 22 preferably also includes one or more adjustable foot rests 98 to support the user's feet when performing certain types of exercises.

Figure 15:
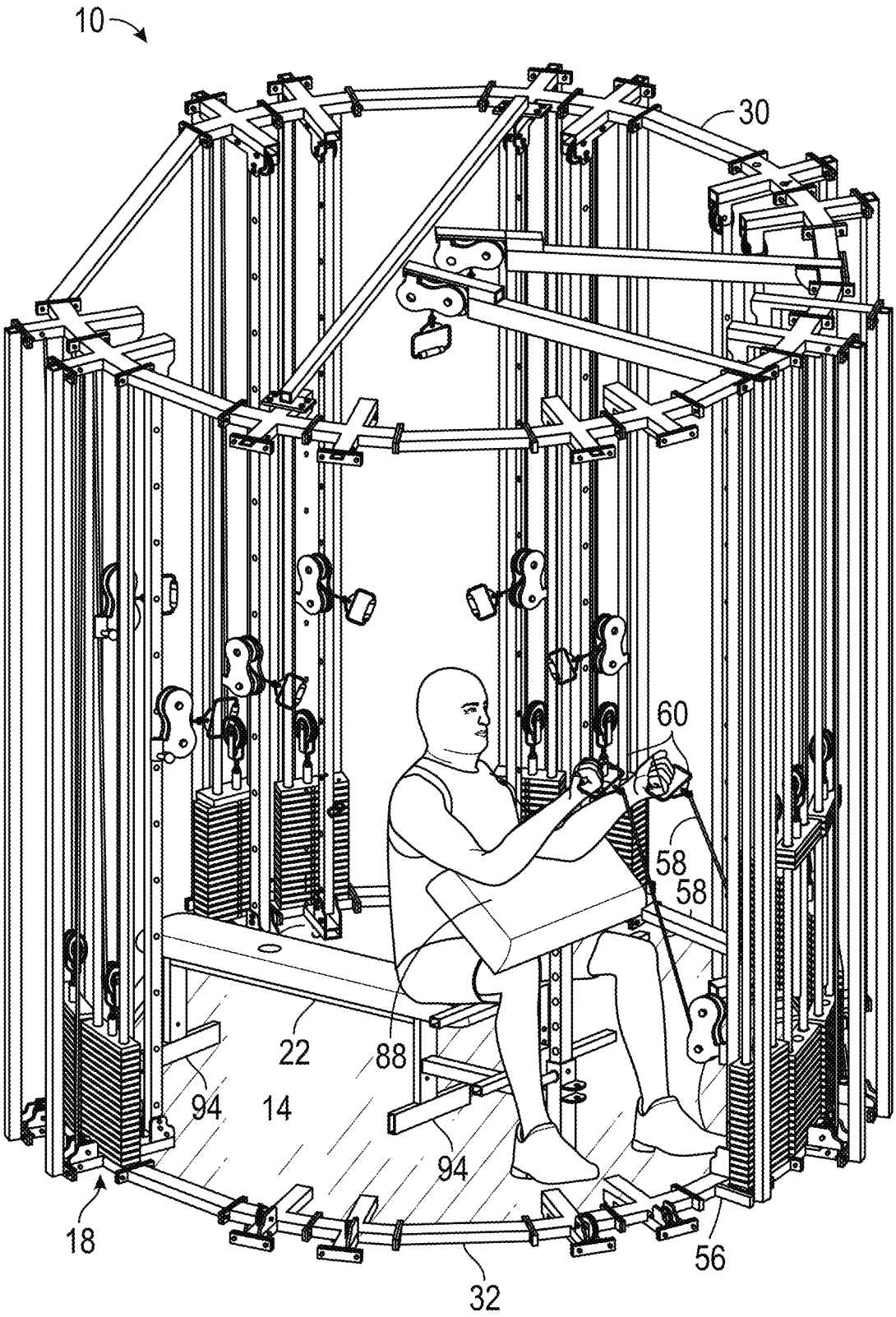
FIG. 15 shows a perspective view of a user using a physical training apparatus in accordance with the present disclosure.

The bench 22 further comprises a back support 84 having an adjustable height relative to the upper surface 82 of the platform 80 of the bench 22. The back support 84 is designed to support the user's back at different elevations relative to the platform 80 when performing certain exercises when sitting on the bench 22. The height of the back support 84 may be adjusted to different heights for different support elevations and to accommodate different users 12. The back support 84 preferably has an elongated cylindrical shape and is positioned across the platform 80 of the bench 22 at a desired vertical position above the platform 80. As shown in FIG. 4, the back support 84 preferably comprises a pair of padded rollers 86 each disposed horizontally above the upper surface 82 of the bench 22. The pair of padded rollers 86 are preferably positioned longitudinally adjacent to each other so that the pair of rollers 86 are longitudinally aligned with each other to form a generally cylindrical shape of the back support 84. Each of the rollers 86 is configured to rotate freely about a longitudinal axis of the roller 86 so that each roller 86 can rotate as the user's back contacts the rollers 86 during normal use. The adjacent rollers 86 are designed so that one of the pair of roller 86 contacts each respective side of the user's back when the user 12 leans onto the back support 84. The platform 80 of the bench 22 is elongated so that the user 12 may sit on the platform 80 with their legs on either side of the platform 80. The longitudinally aligned rollers 86 are disposed in a position that is transverse to the platform 80 so that the longitudinal axis of each roller 86 is generally perpendicular to a longitudinal axis of the platform 80. To adjust the height of the back support 84, the rollers 86 may be attached to a height adjustment arm 90 that extends through an opening 92 in the platform 80. The arm 90 is configured so that the arm 90 does not rotate within the opening 92, and preferably has a squared cross sectional shape, so that the back support 84 is maintained in a transverse position relative to the platform 80 during use. The arm 90 may also be locked into a fixed position to maintain a fixed height of the back support 84 relative to the platform 80 during use. In an optional embodiment, as shown in FIG. 4, the bench 22 may include two opposing supports 96 each configured to secure one of the handles 60 attached to one of the cables 58 of one of the weight modules 18. When the user 12 is done performing an exercise using the bench 22 with the weight modules 18, the user may secure the handles 60 so that the weight stacks 42 will not cause the handles 60 to quickly retract to the stanchion pulleys 54 while the user is still sitting on the bench 22 after completing an exercise. As shown in FIG. 15, the bench 22 may also optionally include an arm support 88 configured to support the user's arms when performing certain exercises.

In a preferred embodiment, as shown in FIG. 5, the back support 84 comprises a plurality of pairs of padded rollers 86 arranged in rows with the rows being positioned laterally adjacent to one another and arranged with each other to collectively form a curved back support 84 that generally defines an upwardly facing convex curve. Each pair of the plurality of pairs of rollers 86 is preferably longitudinally aligned with each other to form one row. A plurality of rows of rollers 86 are arranged adjacent to each other in an arcing configuration to form the convex curved general shape of the back support 84 in a position that is vertically higher than the platform 80. Each of the rollers 86 of the curved back support 84 is preferably configured to rotate freely about a longitudinal axis of the roller 86. Alternatively, the curved back support 84 may comprise a single piece of curved material, which is preferably a rigid material with external padding, that has an upwardly facing convex curved surface. The curved back support 84 may provide added support for the user's back in a supportive shape designed to better fit to the arch of the user's back when the user 12 leans back onto the back support 84 when performing certain exercises using the bench 22. When using either a back support 84 with a single pair of rollers or a curved support 84 with multiple pairs, the user 12 may move their upper body in a manner in which the back support 84 presses against the user's lower back to support the user's back when the user moves their upper body in a backward direction against the back support 84.

FIG. 6 illustrates an alternative embodiment of the bench 22 comprising an elongated massage element 87, which is preferably an elongated rigid piece of material that is covered in padding. The element 87 may be attached to an adjustment arm 90 and installed on the platform 80 of the bench 22 by inserting the arm 90 through the opening 92 in the platform 80. In this embodiment, the element 87 has a longitudinal axis that is parallel to the longitudinal axis of the platform 80 when the element 87 is installed. The element 87 is disposed in a position that is generally directly adjacent to the top of the platform 80 so as to form a ridged area along the longitudinal axis of the platform 80. When the user 12 sits on the platform 80 of the bench 22 with the user's legs on either side of the platform 80, the user 12 will thus be sitting on a top side of the element 87. When using the bench 22 to perform various exercises, the user's body may repeatedly move back and forth in a rocking motion on top of the elongated element 87 and/or slide back and forth short distances along the elongated element 87, which forms a raised area along a centerline of the platform 80. This action may massage the perineum, which may provide external massaging of the male prostate.

Figure 13:
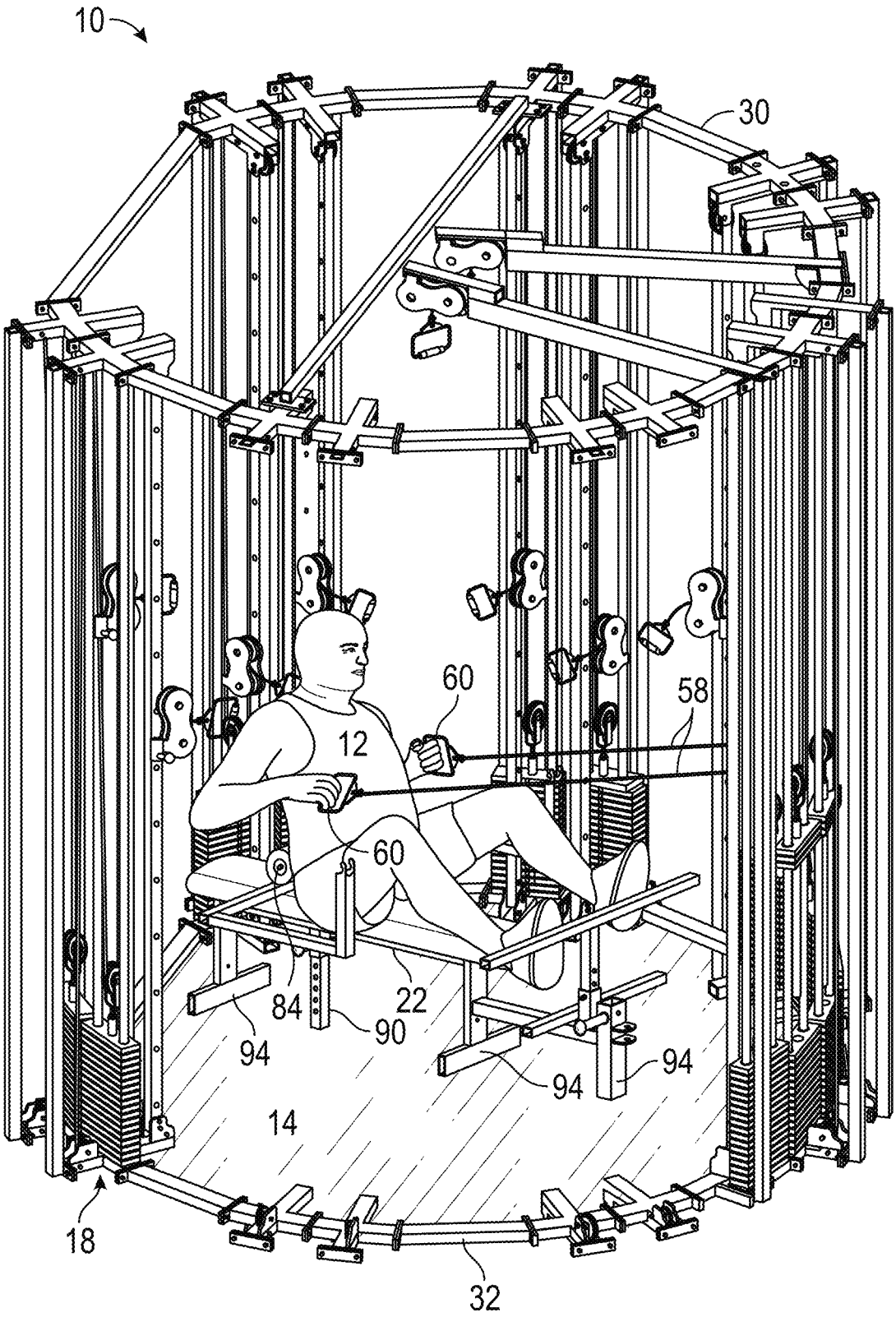
FIG. 13 shows a perspective view of a user using a physical training apparatus in accordance with the present disclosure.
Figure 14:
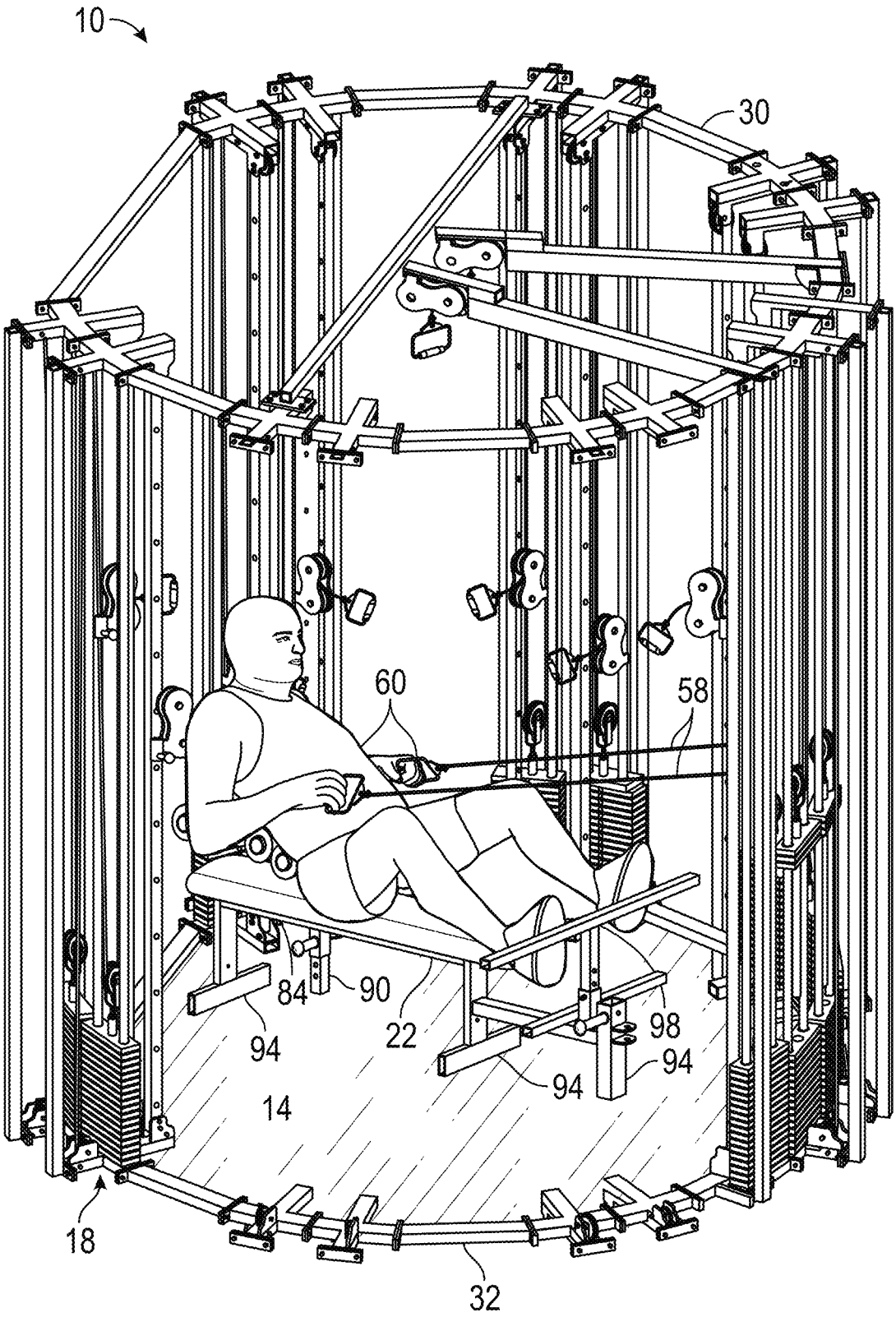
FIG. 14 shows a perspective view of a user using a physical training apparatus in accordance with the present disclosure.

FIGS. 13-16 illustrate example training exercises that may be performed utilizing the bench 22 in combination with the weight modules 18. FIG. 13 shows the user 12 performing an exercise utilizing the back support 84 shown in FIG. 4, and FIG. 14 shows the user 12 performing the same general exercise using the back support 84 shown in FIG. 5. In this exercise, the user 12 is sitting on the bench 22 and utilizing two weight modules 18 positioned in front of the user based on the direction the user is facing when sitting on the bench 22. In this case, the stanchion pulley assemblies 56 are preferably positioned at a height generally level with the user's shoulders when the user is in a sitting position on the bench 22 so that the resistance vectors originate generally from a shoulder height. The user 12 then pulls back on the handles 60 with each arm to lift the weight stacks 42 while simultaneously leaning backward so that the user's back contacts the back support 84. As best seen in FIG. 14, the user 12 may pull the handles 60 and lean backward as far as possible so that the user's back is stretched and massaged by the back support 84 while simultaneously building arm strength. Such an exercise may help the user build overall strength while also relieving back pain.

FIG. 15 shows an optional embodiment utilizing the arm support 88. The arm support 88 may be a removable attachment for the bench 22 that is configured to support the user's arms when performing certain exercises. The arm support 88 preferably comprises a rigid and generally planar element that is padded. The arm support 88 is disposed at an angle to the platform 80 of the bench 22 and at a height that allows it to support the user's arms when the user is sitting on the bench 22. The arm support 88 is preferably at an angle of approximately 45 degrees to the platform 80. To perform this exercise, the stanchion pulley assemblies 56 are preferably positioned on the stanchions 40 at a height that is below the arm support 88. The user 12 may then rest their arms on the support 88 and perform arm exercises while sitting on the bench 22.

Figure 16:
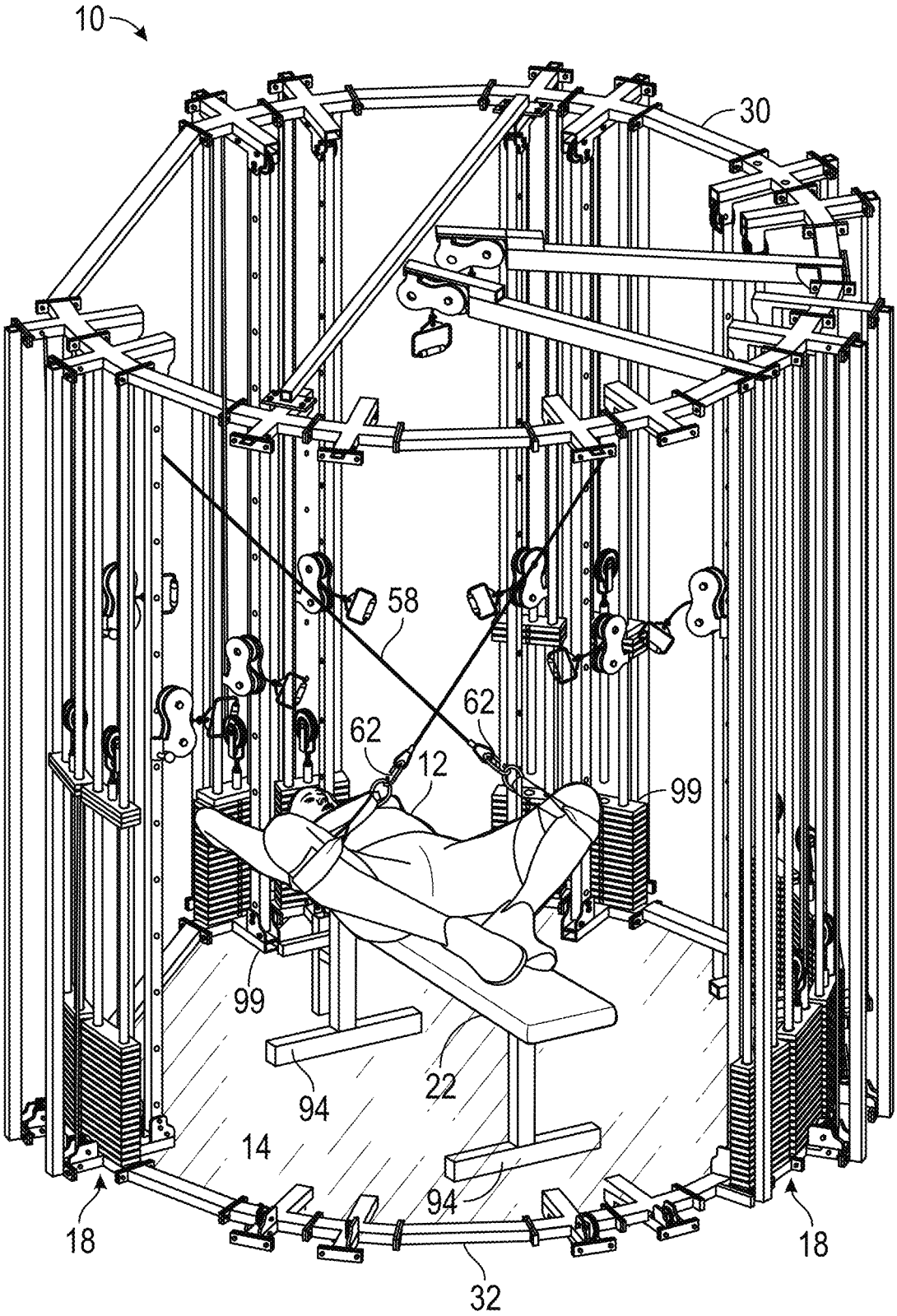
FIG. 16 shows a perspective view of a user using a physical training apparatus in accordance with the present disclosure.

FIG. 16 shows an optional embodiment utilizing a pair of leg harnesses 99 for performing leg exercises, preferably while lying on the bench 22. Each leg harness 99 comprises a connector configured to connect the harness 99 to one of the cables 58 of a weight module 18. To perform this exercise, the leg harnesses 99 may each be wrapped around one of the user's legs and connected to a cable 58 of a weight module 18. The user's legs may then be moved in opposition to resistance vectors, which preferably originate from one of the stanchion pulleys 54 positioned at a height on a stanchion 40 that is higher than the user's legs when the user 12 is lying on the platform 80 of the bench 22. FIG. 16 shows the leg harnesses 99 wrapped around the user's legs below the knee. A variation of this exercise may be performed by wrapping the harnesses 99 around the legs in a position above the knee.

In a preferred embodiment, the apparatus 10 further comprises a headpiece 24 that is adapted to be worn on the user's head. FIGS. 17 and 18 illustrate one preferred embodiment of the headpiece 24. The headpiece 24 may be utilized for neck exercises performed with or without the harness 20 or the bench 22. The headpiece 24 preferably comprises a rigid helmet 100 that fits onto the top of the user's head and has a chinstrap 108 attached thereto for securing the helmet 100 onto the user's head. The chinstrap 108 is preferably relatively wide to provide a better fit onto the user's head and better support to minimize shifting of the helmet 100 on the user's head when being subjected to resistance vector forces during use. The headpiece 24 comprises a plurality of connectors 104 disposed at spaced intervals around a circumference of the headpiece 24 so that the connectors 104 are spaced apart around the user's head when the headpiece 24 is worn. In a preferred embodiment, the headpiece 24 also has a connector 106 positioned at a top end of the headpiece 24, which is generally positioned at the crown of the helmet 100. Each connector 104, 106 is configured to be removably secured to a cable 58 of one of the weight modules 18, 18*a*. Multiple connectors 104 may be connected to different cables 58 of weight modules 18 on opposing sides of the user's head to form resistance vectors from the user's head in opposing directions. Each connector 104, 106 preferably comprises a ring structure. A rigid helmet 100 structure allows the connectors 104, 106 to be attached to the helmet 100 utilizing fasteners such as bolts or screws, thought it should be understood by one of skill in the art that other types of headpieces suitable for attaching connectors thereto for connecting to cables may be utilized.

FIGS. 19 and 20 illustrate example exercises that may be performed using the headpiece 24. FIG. 19 shows the user 12 performing an exercise utilizing both the headpiece 24 and the harness 20. In this exercise, both cables 58 from the overhead pulleys 68, which are connected to weight modules 18*a*, are connected to the top connector 106 of the headpiece 24, and cables 58 connected to other weight modules 18 are connected to the harness connectors 76. Various motions may be performed by the user 12 in this configuration, including squatting motions, as well as various twisting and extension motions. Arm exercises may also be simultaneously incorporated into these exercises utilizing other resistance vectors with handles 60. FIG. 20 shows the user 12 performing an exercise utilizing both the headpiece 24 and the bench 22. To perform this exercise, the user 12 may sit on the bench 22 and connect front and rear headpiece connectors 104 to cables 58 connected to weight modules 18 positioned toward the front and the rear of the user 12. The stanchion pulley assemblies 56 for these weight modules 18 are preferably set at a height generally level with the user's head when the user is sitting on the bench 22. The user 12 may then move their head and upper body back and forth in opposition to the forward and rearward resistance vectors. When leaning backward, the back support 84 may also be utilized to stretch and strengthen the user's back. Utilizing the headpiece 24 to perform exercises such as these, in which the user 12 moves their head in opposition to resistance vectors, may generally help to increase strength in areas of the neck and shoulder and also to reduce pain in these areas.

It will be appreciated that the configurations and methods shown and described herein are illustrative only, and that these specific examples are not to be considered in a limiting sense, because numerous variations are possible. The subject matter of the present disclosure includes all novel and non-obvious combinations and sub-combinations of the various systems and configurations, and other features, functions, and/or properties disclosed herein. It is understood that versions of the invention may come in different forms and embodiments. Additionally, it is understood that one of skill in the art would appreciate these various forms and embodiments as falling within the scope of the invention as disclosed herein.

What is claimed is:

1. A physical training apparatus, comprising:

a base having an upper surface designed to support a user;

a rigid frame that surrounds the base, wherein the rigid frame comprises an upper frame member and a lower frame member;

a plurality of weight modules each attached to the rigid frame, wherein the plurality of weight modules are disposed at spaced intervals around a perimeter of the base so that each weight module of the plurality of weight modules is equidistant from a center point of the upper surface of the base, wherein each weight module of the plurality of weight modules comprises a stanchion attached to the upper frame member and to the lower frame member, wherein each weight module of the plurality of weight modules further comprises a stack of weights and a cable operably connected to the stack of weights via a weight pulley connected to the stack of weights, wherein at least a first portion of the weight modules within the plurality of weight modules includes a stanchion pulley connected to the stanchion, wherein a height of the stanchion pulley on the stanchion is adjustable so that a resistance angle is adjustable by adjusting the height of the stanchion pulley;

a pair of overhead pulleys each positioned above the user when the user is standing on the base within the rigid frame, wherein each overhead pulley of the pair of overhead pulleys is attached to a distal end of a boom arm having a proximal end that is attached to the upper frame member, wherein a height of the distal end of each of the boom arms is adjustable, wherein each of the boom arms extends inwardly over the upper surface of the base, wherein the cable of a respective one of a pair of weight modules within the plurality of weight modules runs through a respective one of the pair of overhead pulleys and is connected to an overhead handle positioned above the user when the user is standing on the base within the rigid frame;

a pair of floor pulleys each secured to the base, wherein the cable of a respective one of a pair of weight modules within the plurality of weight modules runs through a respective one of the pair of floor pulleys and is connected to a lower handle; and a harness adapted to be worn around a waist of the user, wherein the harness comprises a plurality of harness connectors disposed at spaced intervals around the harness, wherein each harness connector of the plurality of harness connectors is configured to be removably secured to the cable of one of the plurality of weight modules, wherein the plurality of harness connectors comprises at least two harness connectors disposed on a front side of the waist of the user, at least two harness connectors disposed on a rear side of the waist of the user, and two opposing harness connectors disposed on opposing lateral sides of the waist of the user when the harness is worn around the waist of the user, and wherein, when the user is in a standing position at the center point of the upper surface of the base, the plurality of weight modules includes at least two weight modules disposed on a front side of the user to define at least two resistance vectors originating from the front side of the user, at least two weight modules disposed on a rear side of the user to define at least two resistance vectors originating from the rear side of the user, and two opposing weight modules disposed on opposing lateral sides of the user to define two opposing resistance vectors originating from the opposing lateral sides of the user.

2. The apparatus of claim 1, wherein the upper frame member and the lower frame member each extend 360 degrees around the center point of the base.

3. The apparatus of claim 1, wherein the weight pulley of each respective one of the plurality of weigh modules is connected to the stack of weights of each respective one of the plurality of weight modules by a rod configured to adjust the number of weights within the stack of weights that are connected to the weight pulley.

4. The apparatus of claim 1, wherein a distal end of the cable of a second portion of the weight modules within the first portion of the plurality of weight modules is attached to a cable connector configured to removably secure to a respective one of the plurality of harness connectors of the harness, and wherein a distal end of the cable of a third portion of the weight modules within the first portion of the plurality of weight modules is connected to a stanchion handle.

5. The apparatus of claim 1, further comprising a headpiece adapted to be worn on the user's head, wherein the headpiece comprises a plurality of headpiece connectors disposed at spaced intervals around the headpiece, wherein each headpiece connector of the plurality of headpiece connectors is configured to be removably secured to the cable of one of the plurality of weight modules.

6. The apparatus of claim 1, wherein the frame has a doorway portion that allows the user to access the base within an interior of the frame.

7. A physical training apparatus, comprising:

a base having an upper surface designed to support a user;

a rigid frame that surrounds the base, wherein the rigid frame comprises an upper frame member and a lower frame member;

a plurality of weight modules each attached to the rigid frame, wherein the plurality of weight modules are disposed at spaced intervals around a perimeter of the base, wherein each weight module of the plurality of weight modules comprises a stanchion attached to the rigid frame, wherein each weight module of the plurality of weight modules further comprises a stack of weights and a cable operably connected to the stack of weights via a weight pulley connected to the stack of weights, wherein each weight module of the plurality of weight modules further comprises a stanchion pulley connected to the stanchion, wherein a height of the stanchion pulley on the stanchion is adjustable so that a resistance angle is adjustable by adjusting the height of the stanchion pulley, and wherein, when the user is in a standing position at a center point of the upper surface of the base, the plurality of weight modules includes at least two weight modules disposed on a front side of the user to define at least two resistance vectors originating from the front side of the user, at least two weight modules disposed on a rear side of the user to define at least two resistance vectors originating from the rear side of the user, and two opposing weight modules disposed on opposing lateral sides of the user to define two opposing resistance vectors originating from the opposing lateral sides of the user; and a bench disposed upon the upper surface of the base and within the rigid frame surrounding the base, wherein the bench comprises an elevated platform having an upper surface designed to support the user, wherein the bench further comprises a back support having an adjustable height relative to the upper surface of the elevated platform of the bench.

8. The apparatus of claim 7, wherein the back support comprises a plurality of padded rollers each disposed horizontally above the upper surface of the elevated platform of the bench, wherein the plurality of rollers are disposed laterally adjacent to each other and arranged with each other to collectively form an upwardly facing convex curved support.

9. The apparatus of claim 8, wherein the plurality of padded rollers are attached to a vertical height adjustment arm that extends through an opening in the elevated platform, wherein the height adjustment arm is configured to lock in a fixed position relative to the upper surface of the elevated platform to adjust the height of the back support relative to the upper surface of the elevated platform.

10. The apparatus of claim 7, wherein the back support is configured to support the user's back when the user is sitting on the bench.

11. The apparatus of claim 7, wherein the back support comprises a padded roller having a cylindrical shape and being disposed horizontally above the upper surface of the elevated platform of the bench, wherein the padded roller is disposed in a position that is transverse to the platform so that a longitudinal axis of the padded roller is perpendicular to a longitudinal axis of the platform.

12. The apparatus of claim 7, wherein the back support comprises a padded support comprising an upwardly facing convex curved support.

13. The apparatus of claim 7, wherein the bench further comprises an elongated element that comprises an elongated rigid piece of material covered in padding, wherein the elongated element is disposed in a position adjacent to the upper surface of the platform, wherein the elongated element has a longitudinal axis that is parallel to a longitudinal axis of the platform, and wherein the elongated element is disposed along a centerline of the platform.

14. The apparatus of claim 7, wherein the bench further comprises an arm support having an adjustable height, wherein the arm support is disposed at an angle to the upper surface of the elevated platform of the bench and is configured to support the user's arms when the user is sitting on the bench.

15. The apparatus of claim 7, further comprising a headpiece adapted to be worn on the user's head, wherein the headpiece comprises a plurality of headpiece connectors disposed at spaced intervals around the headpiece, wherein each headpiece connector of the plurality of headpiece connectors is configured to be removably secured to the cable of one of the plurality of weight modules.

16. The apparatus of claim 7, wherein the plurality of weight modules are disposed at spaced intervals around a perimeter of the base so that each of the weight modules is equidistant from the center point of the upper surface of the base.

17. A physical training apparatus, comprising:

a base having an upper surface designed to support a user;

a rigid frame that surrounds the base, wherein the rigid frame comprises an upper frame member and a lower frame member;

a plurality of weight modules each attached to the rigid frame, wherein the plurality of weight modules are disposed at spaced intervals around a perimeter of the base, wherein each weight module of the plurality of weight modules comprises a stanchion attached to the rigid frame, wherein each weight module of the plurality of weight modules further comprises a stack of weights and a cable operably connected to the stack of weights via a weight pulley connected to the stack of weights, wherein at least a portion of the weight modules within the plurality of weight modules includes a stanchion pulley connected to the stanchion, wherein a height of the stanchion pulley on the stanchion is adjustable so that a resistance angle is adjustable by adjusting the height of the stanchion pulley, and wherein, when the user is in a standing position at a center point of the upper surface of the base, the plurality of weight modules includes at least two weight modules disposed on a front side of the user to define at least two resistance vectors originating from the front side of the user, at least two weight modules disposed on a rear side of the user to define at least two resistance vectors originating from the rear side of the user, and two opposing weight modules disposed on opposing lateral sides of the user to define two opposing resistance vectors originating from the opposing lateral sides of the user; and a headpiece adapted to be worn on the user's head, wherein the headpiece comprises a plurality of headpiece connectors disposed at spaced intervals around the headpiece, wherein each headpiece connector of the plurality of headpiece connectors is configured to be removably secured to the cable of one of the plurality of weight modules.

18. The apparatus of claim 17, wherein the headpiece further comprises a top connector disposed at a crown of the headpiece.

19. The apparatus of claim 17, wherein the headpiece comprises a helmet, wherein each headpiece connector of the plurality of headpiece connectors comprises a ring attached to the helmet, wherein the helmet further comprises a top connector comprising a ring and disposed at a crown of the helmet.

20. The apparatus of claim 17, wherein the plurality of weight modules are disposed at spaced intervals around a perimeter of the base so that each of the plurality of weight modules is equidistant from the center point of the upper surface of the base.

* * * * *